US007637306B2

(12) United States Patent
Fukuda et al.

(10) Patent No.: US 7,637,306 B2
(45) Date of Patent: Dec. 29, 2009

(54) CONTINUOUS CASTING APPARATUS, CONTINUOUS CASTING METHOD AND ALUMINUM ALLOY CAST BAR

(75) Inventors: Masashi Fukuda, Kitakata (JP); Masatoshi Fukushima, Kitakata (JP)

(73) Assignee: Show A Denko K.K., Tokyo (JP)

( * ) Notice: Subject to any disclaimer, the term of this patent is extended or adjusted under 35 U.S.C. 154(b) by 537 days.

(21) Appl. No.: 11/257,096

(22) Filed: Oct. 25, 2005

(65) Prior Publication Data

US 2006/0090875 A1 May 4, 2006

Related U.S. Application Data

(60) Provisional application No. 60/623,339, filed on Nov. 1, 2004.

(30) Foreign Application Priority Data

Oct. 25, 1920 (JP) ..... 2004-309251

(51) Int. Cl.
*B22D 11/045* (2006.01)
*B22D 11/07* (2006.01)

(52) U.S. Cl. ..... 164/472; 164/268; 164/440; 164/490

(58) Field of Classification Search ..... 164/472, 164/268, 490, 440
See application file for complete search history.

(56) References Cited

U.S. PATENT DOCUMENTS 3,286,309 A 11/1966 Brondyke et al.
3,451,465 A * 6/1969 Moritz ..... 164/268
4,598,763 A * 7/1986 Wagstaff et al. ..... 164/472
5,682,942 A 11/1997 Perrin et al.
2006/0118269 A1* 6/2006 Odashima et al. ..... 164/452

FOREIGN PATENT DOCUMENTS

| | | | |
|---|---|---|---|
| JP | 64-015253 | A | 1/1989 |
| JP | 08-032356 | B2 | 3/1996 |
| JP | 11-170009 | A | 6/1999 |
| JP | 11-170014 | A | 6/1999 |
| JP | 2001-334355 | A | 12/2001 |
| JP | 2004-066345 | A | 3/2004 |
| KR | 0371413 | B1 | 1/2003 |
| KR | 0484382 | B1 | 4/2005 |

* cited by examiner

*Primary Examiner*—Kuang Y Lin
(74) *Attorney, Agent, or Firm*—Sughrue Mion, PLLC

(57) ABSTRACT

A continuous casting apparatus, continuous casting method and aluminum alloy cast bar enable stable and smooth high-speed casting with a reduced amount of a lubricant and prevent occurrence of breakout and lubricant reaction products, resulting in reduction in ingot failure. The present invention provides a continuous casting apparatus for producing aluminum alloy cast bars, including a tundish containing molten aluminum alloy, a mold which has an upstream end and a downstream end and to which the molten aluminum alloy is supplied through the upstream end of the mold, an insulation member which is disposed between the tundish and the upstream end of the mold and which has a molten metal passage for allowing communication between the tundish and the mold, and a separation layer disposed on the insulation member and having an aperture which is in communication with the molten metal passage, wherein a lubricant which has been supplied to the mold and transferred to the insulation members is blocked with the separation layer.

16 Claims, 10 Drawing Sheets

210
2a
2c
2b
2c1
2d
2c2
201
r
Rc
200c
211
(Mold side)
(Tundish side)

CONTINUOUS CASTING APPARATUS, CONTINUOUS CASTING METHOD AND ALUMINUM ALLOY CAST BAR

CROSS REFERENCE TO RELATED APPLICATIONS

This application is an application filed under 35 U.S.C. §111(a) claiming the benefit pursuant to 35 U.S.C. §119(e)(1) of the filing dates of Provisional Applications No. 60/623,339 filed Nov. 1, 2004 and Japanese Applications No. 2004-309251 filed Oct. 25, 2004 pursuant to 35 U.S.C §111(b).

BACKGROUND OF THE INVENTION

1. Field of the Invention

The present invention relates to a continuous casting apparatus and continuous casting method for producing aluminum alloy cast bars by supplying molten alloy from a molten metal-receiving portion to a mold through a melt passage which penetrates insulation members provided between the molten metal-receiving portion and the mold; and to aluminum alloy cast bars.

2. Description of the Prior Art

In recent transportation equipment, due to desirability of reducing weight, aluminum alloy parts have come to be employed more frequently. Aluminum alloy parts for such purposes are produced by cutting an aluminum alloy bar to predetermined lengths to thereby produce raw materials for forging and forging the materials into specific parts. In this case, the aluminum alloy bar is manufactured through plastic processing and thermal processing of a material produced, for example, by horizontal continuous casting.

Generally speaking, horizontal continuous casting transforms molten metal into elongated cast ingots of, for example, round columnar, square columnar or hollow cylindrical shape, through the following steps. That is to say, molten metal which is supplied to a tundish that receives molten metal passes through a passage surrounded by a refractory material and enters an approximately horizontal cylindrical mold, where the molten metal is forcibly cooled to form a solidifying shell outside the molten metal body. When the thus produced cast ingot exits the mold, a coolant such as water is directly injected, allowing solidification of the metal to progress towards the core of the ingot to thereby attain continuous casting.

In the horizontal continuous casting, a lubricant is introduced to the inner wall surfaces of the mold on its inlet side to thereby prevent seizure of molten metal on the mold lining. In the mold, due to the difference in the gravimetric force applied to the top and bottom faces of an ingot, the lubricant climbs up from the lower part of the wall surface toward the upper part thereof. Gases produced from decomposition of the heated lubricant also move upward along the wall surface. These phenomena create unevenness between high and low portions of the mold in terms of the lubrication state between the mold inner wall and the molten metal or the solidifying shell of a cast ingot.

For example, in a lower portion of the mold, since no lubricant is present between the mold inner wall and the molten metal or the solidifying shell, the molten metal seizes on the mold's inner wall, breaking the solidifying shell to allow the not-yet-solidified molten metal to outflow, producing a large casting defect, or in an extreme case, tearing off the ingot and preventing continuation of the casting operation. Meanwhile, at an upper portion of the mold inner wall, since lubricant is present in an excessive amount, which prevents close contact between the molten metal and the mold inner wall, the molten metal cannot be sufficiently cooled by the mold, permitting blowing out of unsolidified molten metal from the upper portion of the cast ingot.

In order to overcome such essential problems involved in horizontal continuous casting of metal, a variety of countermeasures have been proposed in, for example, JP-B HEI 8-32356(hereinafter referred to as Patent Document 1), JP-A HEI 11-170009 (hereinafter referred to as Patent Document 2) and JP-B HEI 11-170014 (hereinafter referred to as Patent Document 3).

Of the above-listed Patent Documents 1, 2 and 3, Patent Documents 1 and 2 are concerned with supply of lubricant, and Patent Document 3 is directed to means for attaining uniformity in temperature distribution of the molten metal within the mold.

Patent Document 1 attempts to provide a horizontal continuous metal casting method and a relevant apparatus which are free from the problems involved with conventional horizontal continuous metal casting methods, such as the imbalance in cooling of molten metal within the mold and uneven thickness of the lubricant film on the mold inner wall, and which are capable of consistently producing high-quality cast ingots exhibiting a uniform microstructure of cast ingot and having no casting surface flaw or breakout. Specifically, this document discloses a horizontal continuous metal casting method in which, while a lubricating fluid is supplied to a forcibly cooled, virtually horizontal cylindrical mold, molten metal is supplied at the upstream end of the cylindrical mold to thereby form a columnar molten metal body, and at the downstream end of the cylindrical mold, a solidified columnar cast ingot, which has been formed as a result of solidification of the columnar molten metal body, is withdrawn, wherein the lubricating fluid is caused to permeate into the pores of the mold's permeable porous member provided on the inner wall of the cylindrical mold to thereby cause continuous seepage of the lubricating fluid onto the inner wall of the cylindrical mold that faces not-yet-solidified molten metal or now-solidifying molten metal, while the lubricating fluid and/or a gas primarily containing gas components produced from decomposition of the lubricating fluid is/are released from an ingot outlet end of the mold via grooves formed on the inner wall of the cylindrical mold, such that the amount of the lubricating fluid that seeps onto an upper portion of the mold's permeable porous member is regulated to be smaller than the amount of the lubricating fluid that seeps onto a lower portion of the mold's permeable porous member.

Patent Document 2 discloses a horizontal continuous casting method for aluminum or aluminum alloy, in which an appropriate amount of a lubricant is caused to be present uniformly on the mold's inner wall in all radial directions to thereby improve the surface quality of cast ingots, and also to enhance yield by reducing the thickness of the inverse segregation layer and thus the amount of peeling. Specifically, to attain this, a plurality of lubricant supply holes are provided at the inner wall of the upper half section of the mold, and the supply amount of the lubricant is regulated to fall within a range of 0.001 to 0.012 cc/min·mm per unit outer peripheral length of the cast ingot. Moreover, a self-lubricating carbon sleeve is shrink-fitted on the inner wall of the metallic mold to be cooled.

Patent Document 3 discloses a horizontal continuous casting apparatus having, in a gate insulating member of a mold for the apparatus, a molten metal supply inlet through which molten metal is supplied from a furnace to the mold, which is provided at a point that falls within a region extending downward from the center of the mold as viewed in its cross section, and which has a cross sectional area of 10 to 25% the entire cross section of the mold to thereby attain uniformity in temperature distribution of molten metal within the mold, to diminish the cold shut which may be formed in a lower portion of a cast ingot and to reduce the thickness of an inverse segregation layer formed in the ingot surface, and as a result, to improve yield by reducing the peeling amount of a cast ingot and simultaneously to suppress occurrence of breakout.

In recent years, in order to ensure stable production operation of horizontal continuous casting, a large amount of lubricant is often required for attaining adequate lubrication. For example, amid mounting demands for aluminum alloy parts, improvement in productivity of the raw material; i.e., aluminum alloy bars, has become of keen interest. To attain this, casting speed must be increased, which in turn requires an increase in the supply amount of lubricant for preventing seizure.

If a large amount of lubricant is supplied, however, an excessive amount of gas may be produced to cause breakout, or when an excessive amount of lubricant contacts molten metal, lubricant reaction products will be produced. These incidents are unfavorable, as they results in production of defective cast ingots.

In view of the foregoing, the present invention is directed to providing a horizontal continuous casting apparatus and a horizontal continuous casting method which enable stable and smooth high-speed casting with a reduced amount of a lubricant and which prevent occurrence of breakout and production of lubricant reaction products, attaining reduction in ingot failure, as well as an aluminum alloy cast bar produced through use of the apparatus or the method.

To attain the above object, the present invention discloses a continuous casting apparatus, a continuous casting method and an aluminum alloy cast bar having the following characteristic features.

SUMMARY OF THE INVENTION

In order to solve the problems, a first aspect of the invention provides a continuous casting apparatus for producing aluminum alloy cast bars, comprising a molten metal-receiving portion containing molten aluminum alloy; a mold which has an upstream end and an downstream end and to which the molten alloy is supplied through the upstream end of the mold; an insulation member which is disposed between the molten metal-receiving portion and the upstream end of the mold and which has a molten metal passage for allowing communication between the molten metal-receiving portion and the mold; and a separation layer disposed on the insulation member and having an aperture which is in communication with the molten metal passage.

In a second aspect of the invention that includes the first aspect, the mold is disposed horizontally.

In a third aspect of the invention that includes the first aspect, the insulation member is inserted between the upstream end of the mold and the separation layer.

In a fourth aspect of the invention that includes the second aspect, the insulation member is inserted between the upstream end of the mold and the separation layer.

In a fifth aspect of the invention that include the third aspect, the separation layer has on a side of the aperture a circumferential portion bending toward the upstream end of the mold.

In a sixth aspect of the invention that includes the fourth aspect, the separation layer has on a side of the aperture a circumferential portion bending toward the upstream end of the mold.

In a seventh aspect of the invention that includes the third aspect, in relation to the insulation member disposed between the upstream end of the mold and the separation layer, the insulation member has a portion facing a hollow portion of the mold and having an area of 40 to 85%, in an area ratio, of a radial cross sectional area of the hollow portion of the mold.

In an eighth aspect of the invention that includes the fourth aspect, in relation to the insulation member disposed between the upstream end of the mold and the separation layer, the insulation member has a portion facing a hollow portion of the mold and having an area of 40 to 85%, in an area ratio, of a radial cross sectional area of the hollow portion of the mold.

In a ninth aspect of the invention that includes the fifth aspect, in relation to the insulation member disposed between the upstream end of the mold and the separation layer, the insulation member has a portion facing a hollow portion of the mold and having an area of 40 to 85%, in an area ratio, of a radial cross sectional area of the hollow portion of the mold.

In a tenth aspect of the invention that includes the sixth aspect, in relation to the insulation member disposed between the upstream end of the mold and the separation layer, the insulation member has a portion facing a hollow portion of the mold and having an area of 40 to 85%, in an area ratio, of a radial cross sectional area of the hollow portion of the mold.

In an eleventh aspect of the invention that includes the first aspect, the separation layer is formed of a material which prevents passage of a lubricant and a gasified lubricant therethrough.

In a twelfth aspect of the invention that includes the second aspect, the separation layer is formed of a material which prevents passage of a lubricant and a gasified lubricant therethrough.

In a thirteenth aspect of the invention that includes the second aspect, the mold is provided in an inner wall thereof at a position proximal to the upstream end thereof with a lubricant supply conduit that is extended toward the downstream end of the mold.

In a fourteenth aspect of the invention that includes the second aspect, the mold is provided in an inner wall thereof at a position proximal to the upstream end thereof with a lubricant supply conduit that is branched, so that a branched end thereof is located at a position proximal to the downstream end of the mold.

In a fifteenth aspect of the invention that includes the second aspect, the mold and molten metal passage have a relationship defined such that a lowermost position of an inner wall of the molten metal passage is higher than a lowermost position of an inner wall of the mold by 8% or more of an inner diameter of the mold.

In a sixteenth aspect of the invention that includes the first aspect, the molten aluminum alloy has a magnesium content of 0.5 mass % or more.

In a seventeenth aspect of the invention that includes the second aspect, the molten aluminum alloy has a magnesium content of 0.5 mass % or more.

In a eighteenth aspect of the invention that includes the first aspect, the molten aluminum alloy has a composition of Si (content: 0.05 to 1.3 mass %), Fe (content: 0.1 to 0.7 mass %), Cu (content: 0.1 to 2.5 mass %), Mn (content: 0.05 to 1.1 mass %), Mg (content: 0.5 to 3.5 mass %), Cr (content: 0.04 to 0.4 mass %) and Zn (content: 0.05 to 8.0 mass % or less).

In a nineteenth aspect of the invention that includes the second aspect, the molten aluminum alloy has a composition of Si (content: 0.05 to 1.3 mass %), Fe (content: 0.1 to 0.7 mass %), Cu (content: 0.1 to 2.5 mass %), Mn (content: 0.05 to 1.1 mass %), Mg (content: 0.5 to 3.5 mass %), Cr (content: 0.04 to 0.4 mass %) and Zn (content: 0.05 to 8.0 mass % or less).

A twentieth aspect of the invention provides a continuous casting method for producing aluminum alloy cast bars, comprising the steps of providing an insulation member which is disposed between a molten metal-receiving portion containing molten aluminum alloy and an upstream end of a mold also having a downstream end and which has a molten metal passage for allowing communication between the molten metal-receiving portion and the mold, with a separation layer having an aperture which is in communication with the molten metal passage; supplying the molten alloy to the mold through the upstream end of the mold; and performing continuous casting while blocking a lubricant which has been supplied from a lubricant supply conduit to the mold and transferred to the insulation member with the separation layer.

In a twenty-first aspect of the invention that includes the twentieth aspect, the mold is disposed horizontally.

In a twenty-second aspect of the invention that includes the twenty-first aspect, the lubricant supply conduit is provided in an inner wall of the mold at a position proximal to the upstream end of the mold and extended toward the downstream end of the mold.

In a twenty-third aspect of the invention that includes the twenty-first aspect, the lubricant supply conduit provided in the inner wall of the mold at a position proximal to the upstream end of the mold is branched, so that a branched end thereof is located at a position proximal to the downstream end of the mold.

In a twenty-fourth aspect of the invention that includes the twenty-first aspect, the molten metal passage and mold have a relationship such that a lowermost position of an inner wall of the molten metal passage is higher than a lowermost position of an inner wall of the mold by 8% or more of an inner diameter of the mold.

A twenty-fifth aspect of the invention provides an aluminum alloy cast bar produced through the continuous casting method according to the twentieth aspect.

A twenty-sixth aspect of the invention provides an aluminum alloy cast bar produced through the continuous casting method according to the twenty-first aspect.

According to the first, second, twentieth and twenty-first aspects of the invention, the insulation member is provided with the separation layer. Therefore, since the separation layer blocks the lubricant which has been supplied into the mold and transferred to the insulation member, it prevents the lubricant from reacting with the molten alloy and from entering the molten metal-receiving portion. This suppresses consumption of the lubricant, resulting in reduction in the amount of the lubricant. Thus, high-speed casting can be performed stably and smoothly with a reduced amount of the lubricant. In addition, there are not produced lubricant reaction products which would otherwise be produced on the wall surface of the insulation member or in the vicinity thereof, resulting in considerable reduction in ingot failure rate.

Incidentally, blocking the lubricant which has been supplied into the mold and transferred to the insulation member with the separation layer includes a case where it can completely prevent the lubricant reaching the separation layer from the mold from reacting with the molten alloy and from entering the molten metal-receiving portion and a case of not the complete prevention, but where waste consumption of the lubricant by the reaction with the molten alloy and by the transfer to the molten metal-receiving portion can be reduced.

According to the third and fourth aspects of the invention, since the insulation member is provided between the upstream end of the mold and the separation layer, the molten alloy can be supplied to the mold while retaining heat, even when the separation layer is made of a material which readily removes heat. Therefore, the molten alloy starts to solidify at a predetermined, appropriate position within the mold, enabling stable casting.

According to the fifth and sixth aspects of the invention, since the aperture circumferential portion of the separation layer is bent toward and extended to face the upstream end of the mold, the insulation member provided between the upstream end of the mold and the separation layer is prevented from coming into contact with the molten alloy at the periphery facing the molten metal passage. Therefore, the lubricant can be reliably prevented from reacting with the molten alloy after passing through the insulation member and also prevented from entering the molten metal-receiving portion.

According to the seventh to tenth aspects of the invention, since the area of a certain portion of the insulation member disposed between the upstream end of the mold and the separation layer, i.e. the area of a portion of the insulation member that faces the hollow space of the mold, is 40 to 85% of the longitudinal cross-sectional area of the hollow space of the mold, an area of the insulation member that is needed for insulation is ensured from facing the hollow space of the mold. Thus, when the molten alloy is supplied to the mold, heat of the molten alloy is prevented from being removed at the upstream end of the mold and thus from being cooled. Therefore, molten alloy starts to solidify at a predetermined appropriate position within the mold, enabling stable casting.

According to the thirteenth and twenty-second aspects of the invention, since the lubricant supply conduit provided in the inner wall of the mold at a position proximal to the upstream end of the mold is extended toward the downstream end of the mold, the lubricant can also be supplied into the mold at a position of the conduit which is proximal to the downstream end of the mold. In the case of high-speed casting, the position where column-shaped molten metal starts to solidify tends to move toward the downstream end of the mold. In order to supply the lubricant to the solidification starting position, conventionally, an amount of lubricant greater than necessary has been supplied into the mold at a position of the conduit proximal to the upstream end of the mold. In these aspects of the invention, appropriate supply of the lubricant into the mold can be attained through use of the extended portion of the lubricant supply conduit which enables supply of the lubricant at a position proximal to the downstream end of the mold. That is, the lubricant is supplied in an appropriate amount to a place in need thereof. Therefore, the lubricant is supplied only in a necessary amount, and thus high-speed casting can be performed stably and smoothly while employing a reduced amount of lubricant.

According to the fourteenth and twenty-third aspects of the invention, since the lubricant supply conduit is provided in the inner wall of the mold at a position proximal to the upstream end of the mold and then branched, so that a branched end thereof is located at a position proximal to the downstream end of the mold, the lubricant can also be supplied into the mold at a position of the conduit which is proximal to the downstream end of the mold. In the case of high-speed casting, the position where the molten metal starts to solidify tends to move toward the downstream end of the mold. In order to supply the lubricant to the solidification starting position, conventionally, a greater amount of the lubricant, the amount being greater than necessary, has been supplied into the mold at a position of the conduit proximal to the upstream end of the mold. In these aspects of the invention, appropriate supply of the lubricant into the mold can be attained through use of the branched lubricant supply conduit which enables supply of the lubricant at a position proximal to the downstream end of the mold. That is, the lubricant is supplied in an appropriate amount to a place in need thereof. Therefore, the lubricant is supplied only in a necessary amount, and thus high-speed casting can be performed stably and smoothly while employing a reduced amount of lubricant.

According to the fifteenth and twenty-fourth aspects of the invention, since the relationship between the mold and a molten metal passage which is defined in the insulation member is defined such that the lowermost position of the inner wall of the molten metal passage is higher than the lowermost position of the inner wall of the mold by 8% or more of the inner diameter of the mold, the temperature of the lower part of the molten alloy which is supplied to the upstream end of the mold is decreased as compared to the conventional case where the molten metal passage is provided at the lowermost position of the inner wall of the mold so as to attain uniform temperature distribution in the formed ingot. This reduction in temperature enables rapid solidifying shell formation in the lower part of the ingot. Thus, casting can stably be performed with decreased amount of the lubricant. Therefore, high-speed casting can be performed stably and smoothly while the amount of the lubricant is reduced. Further, since the temperature of the molten alloy supplied to the lower part of the upstream end of the mold is lowered, gasification of the lubricant can be prevented, preventing ingot failure which may otherwise caused by incorporation of gasified lubricant.

According to the sixteenth and seventeenth aspects of the invention, since the first and second aspects of the invention are applied in casting of aluminum alloy having a magnesium content of 0.5 mass % or more, while conventionally, such a magnesium-containing aluminum alloy has been difficult to cast stably without using a larger amount of the lubricant, effects similar to those described above in relation to high-speed casting can be exhibited, including reduction in the amount of the lubricant, prevention of occurrence of lubricant reaction products, stable and smooth casting, and prevention of occurrence of ingot failure.

DETAILED DESCRIPTION OF THE PREFERRED EMBODIMENTS

The exemplified embodiments of the present invention will next be described in more detail with reference to the drawings.

Firstly, an aluminum alloy cast bar will be described. In the present invention, an aluminum alloy cast bar is produced through a horizontal continuous casting method employing a cylindrical mold which has a center axis maintained approximately horizontally (i.e., laterally) and which is provided with forced cooling means. The aluminum alloy cast bar may have a diameter of 10 mm to 100 mm. An aluminum alloy cast bar having a diameter smaller than or larger than the above range may be produced. However, the diameter preferably falls within the range of 10 mm to 100 mm, since, within this range, an industrially acceptable, small-scale, inexpensive apparatus can be employed in plastic machining in post processing, such as forging, roll forging, drawing, rolling and impact machining. An aluminum alloy cast bar having a different diameter may be cast by replacing the cylindrical mold, which is replaceable, by another cylindrical mold which has an inner diameter corresponding to the bar diameter, and modifying the molten metal temperature and the casting speed correspondingly. Also, the amounts of cooling water and lubricant are modified in accordance with needs.

The thus produced aluminum alloy cast bar may be used as a material to be processed in plastic machining in the post processing, such as forging, roll forging, drawing, rolling or impact machining. Alternatively, the aluminum alloy cast bar may be used as a material to be processed in a machining process, such as bar machining or drilling.

Next a first embodiment of the present invention will be described with reference to FIGS. 1 to 5.

Figure 1:
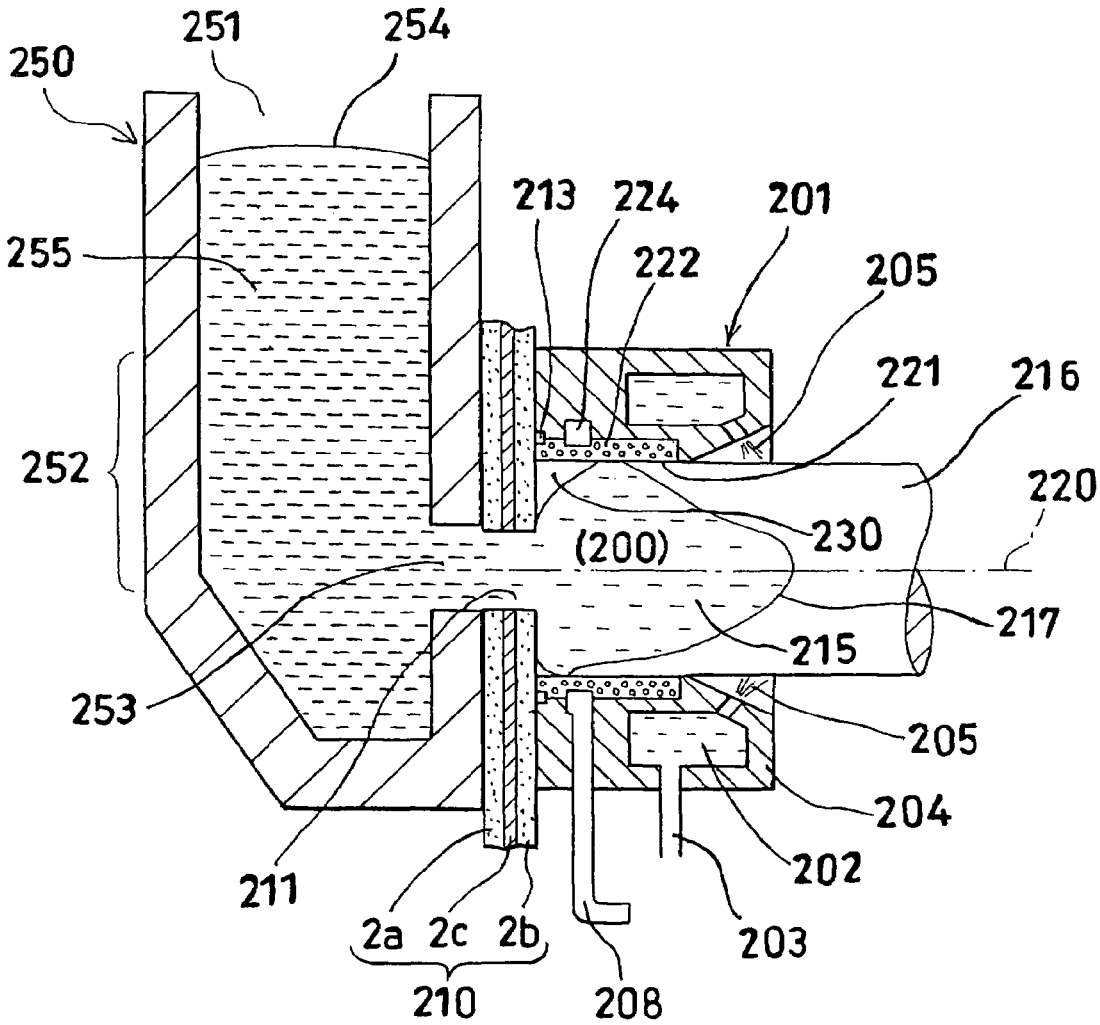
FIG. 1 is a schematic cross sectional view of main parts, showing the vicinity of the mold of the horizontal continuous casting apparatus according to the present invention.

FIG. 1 shows the vicinity of a mold of the horizontal continuous casting apparatus of the present invention. In FIG. 1, the molten metal-receiving portion is a tundish 250. The tundish 250, a refractory plate 210 and a cylindrical mold (hereinafter referred to simply as "mold") 201 are located such that molten alloy 255 stored in the tundish 250 is supplied via the refractory plate 210 to the mold 201. As described later in detail, the refractory plate 210 comprises a first insulation member 2*a*, a second insulation member 2*b* and a separation layer 2*c*. The mold 201 is supported such that the mold center axis 220 becomes approximately horizontal. In order to solidify the molten alloy 255 to form a solidified ingot 216, the mold 201 is provided therein with forced cooling means for cooling the mold 201 and at the exit thereof with forced cooling means for cooling the solidified ingot 216. In FIG. 1, as means for forcedly cooling the solidified ingot 216, a cooling water showering apparatus 205 is provided. In the vicinity of the exit of the mold 201, a driving apparatus for withdrawal (not shown) is provided for withdrawing the forcedly cooled solidified ingot 216 at a constant speed to perform continuous casting. In addition, a synchronized cutter (not shown) is provided for cutting the continuously produced aluminum alloy cast bar into pieces having a predetermined length.

As shown in FIG. 1, the mold 201 has two forced cooling means; i.e., one for cooling the wall surface of the mold through use of cooling water 202 passing through a mold-cooling water cavity 204 so that the heat of column-shaped molten metal 215 contained in the mold 201 is removed via the contact surface of the mold 201 for formation of a solidifying shell in the surface area of the molten metal; and the other for cooling molten alloy at the exit end of the mold through direct injection of cooling water from a cooling water showering apparatus 205 so that the column-shaped molten metal 215 in the mold is solidified. The mold 201 is connected, at the end thereof opposite the end provided with injection ports of the cooling water showering apparatus 205, to the tundish 250 via the refractory plate 210. In FIG. 1, cooling water for forcedly cooling the mold 201 and cooling water for forcedly cooling molten alloy are supplied via a common cooling water supply tube 203. Alternatively, separate cooling water supply tubes may be provided.

Preferably, the forced cooling means for cooling the mold 201 and the cooling water showering apparatus 205 are independently controlled by control signals.

Figure 2:
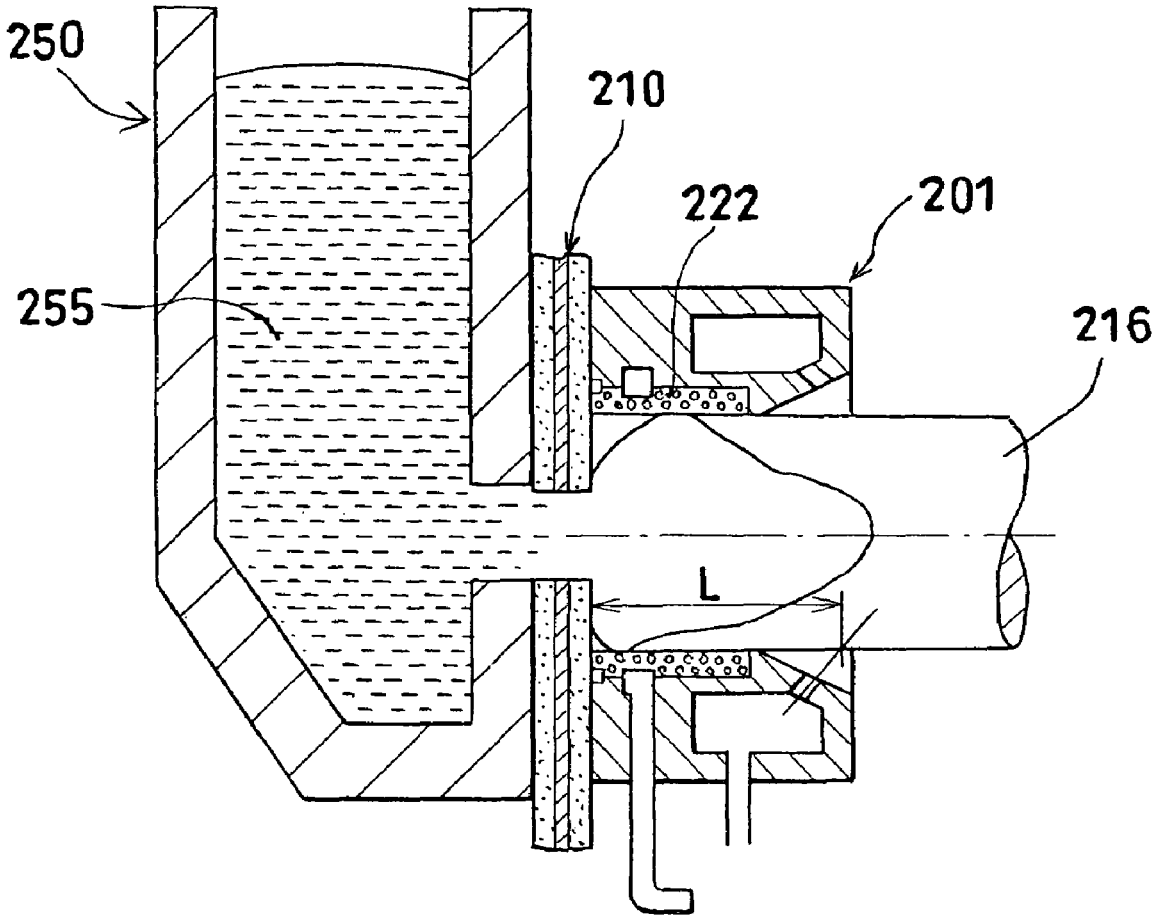
FIG. 2 is a diagram illustrating the effective mold length of the mold shown in FIG. 1.

The distance from the position where an extension of the center axis of an injection port of the cooling water showering apparatus 205 crosses the surface of the solidified ingot 216 to the surface of contact between the mold 201 and the refractory plate 210 is called "effective mold length" (see L in FIG. 2). The effective mold length L is preferably 15 mm to 70 mm. When the effective mold length L is shorter than 15 mm, casting is impossible since a solidifying shell cannot be formed sufficiently. When the effective mold length exceeds 70 mm, cooling effect of forced cooling is minimized, and solidification is induced predominantly by the wall of the mold. Therefore, the resistance of contact between the mold 201 and the molten alloy 255 or a solidifying shell becomes high, causing, for example, occurrence of cracks in the casting surface and breakage of the ingot in the mold, resulting in unfavorable, unstable casting.

The material of the mold 201 is preferably one species or a combination of two or more species selected from among aluminum, copper and alloys of aluminum or copper. The material may be selected to attain the desired thermal conductivity, heat resistance or mechanical strength.

Preferably, a permeable porous material 222 having a self-lubricity is annularly fitted to a portion of the inner wall 221, which is brought into contact with the molten alloy 255, of the mold 201. The term "annularly" means that the entire circumference of the inner wall surface 221 of the mold 201 as seen in the longitudinal direction is covered. The permeable porous material 222 preferably has an air permeability of 0.005 L/(cm$^2$×min) to 0.03 L/(cm$^2$×min), more preferably 0.007 L/(cm$^2$×min) to 0.02 L/(cm$^2$×min). No particular limitation is imposed on the thickness of the permeable porous material 222. However, the thickness is preferably 2 mm to 10 mm, more preferably 3 mm to 8 mm. As the permeable porous material 222, there may be employed, for example, graphite having an air permeability of 0.008 L/(cm$^2$×min) to 0.012 L/(cm$^2$×min). As used herein, the air permeability of a material refers to the amount of air, per minute, which passes through a test sample of the material having a thickness of 5 mm, when air is applied at a pressure of 2 kg/cm$^2$.

Preferably, in the mold 201, the portion to which the permeable porous material 222 is fitted extends 5 mm to 15 mm within the effective mold length L. Preferably, an O-ring 213 is provided at a contact portion between the refractory plate 210, the mold 201 and the permeable porous material 222.

The radial direction cross sectional shape of the inner wall of the mold 201 (inner wall surface shape when seeing a hollow space 200 of the mold 201 from the downstream side) may be circular, triangular, rectangular, polygonal, semicircular or elliptical, or may form heteromorphic shapes which may or may not have a center axis or plane of symmetry. Alternatively, when a hollow ingot is to be formed, the mold may have a core cylinder held inside the mold. Thus, in the mold 201, which is a cylindrical mold having open ends at opposite sides, the molten alloy 255 which is supplied through a molten metal passage 211 defined in the refractory plate 210 enters, at the upstream end of the mold, into the interior of the hollow mold, and the solidified ingot 216 is pushed out or withdrawn through the downstream end of the mold.

The longitudinally cross-sectional shape of the molten metal passage 211 may be circular, semicircular, pyriform or horseshoe.

The mold inner wall is formed at an elevation angle of 0 degree to 3 degrees (preferably 0 degree to 1 degree) with respect to the mold center axis 220. That is to say, the mold inner wall is tapered to open like a corn toward the direction in which the solidified ingot 216 is withdrawn, and the angle forming the taper is the elevation angle. When the elevation angle is less than 0 degree, larger resistance occurs at the exit of the mold when the solidified ingot 216 is pulled out of the mold 201, resulting in difficulty in casting, whereas when the angle is larger than 3 degrees, contact between the mold inner wall surface and the column-shaped molten metal 215 is insufficient, resulting in reduction in the amount of heat removed from the molten alloy 255 and the solidifying shell to the mold 201, causing insufficient solidification. As a result, unfavorable phenomena tend to occur in casting. For example, surface defects caused by re-melted metal may be formed on the ingot surface, or molten alloy 255, which has not been solidified, may gush from the end of the mold.

The tundish 250 comprises a molten metal inlet 251 for receiving molten aluminum alloy having a predetermined alloy composition which has been regulated at an external melting furnace or a similar apparatus, a molten metal storage portion 252 and an outlet 253 opening to the mold 201. The tundish 250 is adapted to maintain the level 254 of the molten alloy 255 above the mold 201. In the case of multiple continuous casting, the tundish 250 is further adapted to consistently distribute the molten alloy 255 to cylindrical molds 201. The molten alloy 255 stored in the molten metal storage portion 252 of the tundish 250 flows into the mold 201 via a molten metal passage 211 defined in the refractory plate 210.

Reference numeral 208 denotes a fluid supply tube for supplying a fluid. Examples of the fluid include a lubricating fluid. The fluid may be one or more species selected from among gases and liquid lubricants. A gas and a liquid lubricant are preferably supplied through separate tubes. The pressurized fluid supplied through the fluid supply tube 208 flows through an annular lubricant supply conduit 224 and is then supplied to a gap formed between the mold 201 and the refractory plate 210. Preferably, the mold 201 and the refractory plate 210 define a gap of 200 μm or less therebetween. The gap of this size enables the molten alloy 255 not to flow into the gap and the fluid to flow toward the inner wall surface 221 of the mold 201. In the embodiment shown in FIG. 1, the lubricant supply conduit 224 is defined such that the conduit 224 opens toward the outer circumferential surface of the permeable porous material 222 fitted in the mold 201. Thus, the pressurized fluid permeates the permeable porous material 222, is delivered to the entire surface of the permeable porous material 222 that is in contact with the molten alloy 255, and is supplied to the inner wall surface 221 of the mold 201. Some liquid lubricants may produce a gas through decomposition by application of heat before being supplied to the inner wall surface 221 of the mold 201.

One or more species selected from the supplied gas, the supplied liquid lubricant and a gas produced through decomposition of the supplied liquid lubricant form a corner space 230.

Figure 3A:
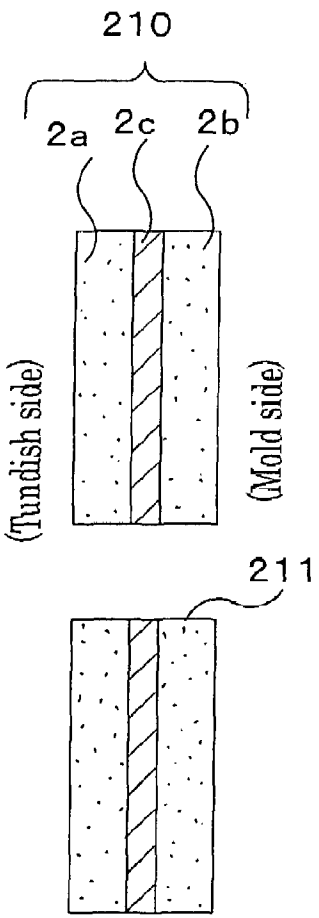
FIG. 3 is a diagram illustrating the refractory plate employed in the present invention.
Figure 3B:
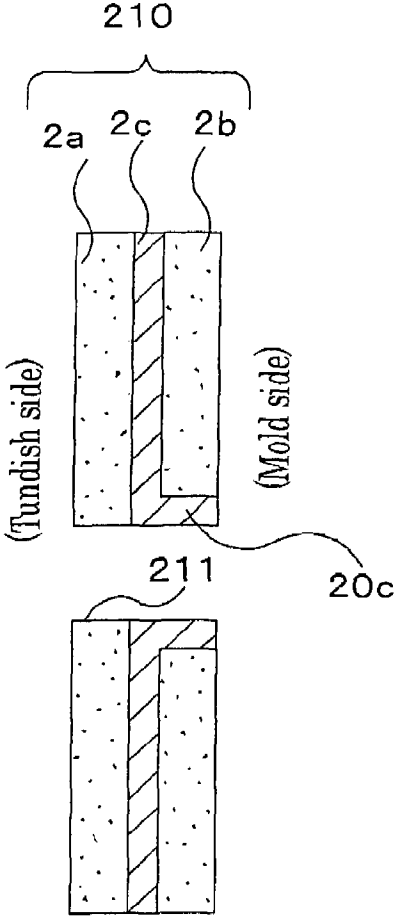
Figure 3C:
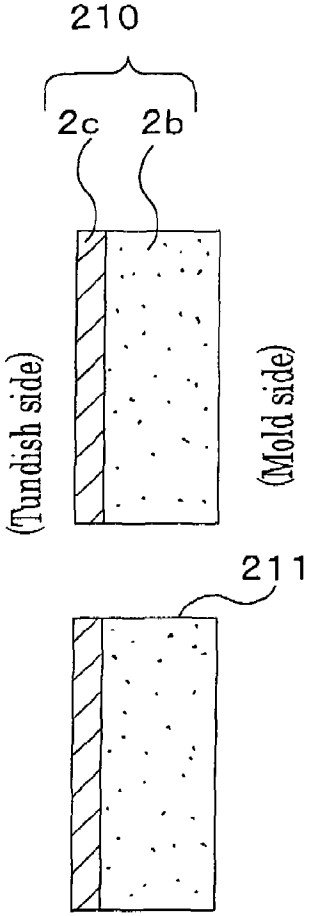
Figures 4D, 4E, 4F, 4G, 4H:
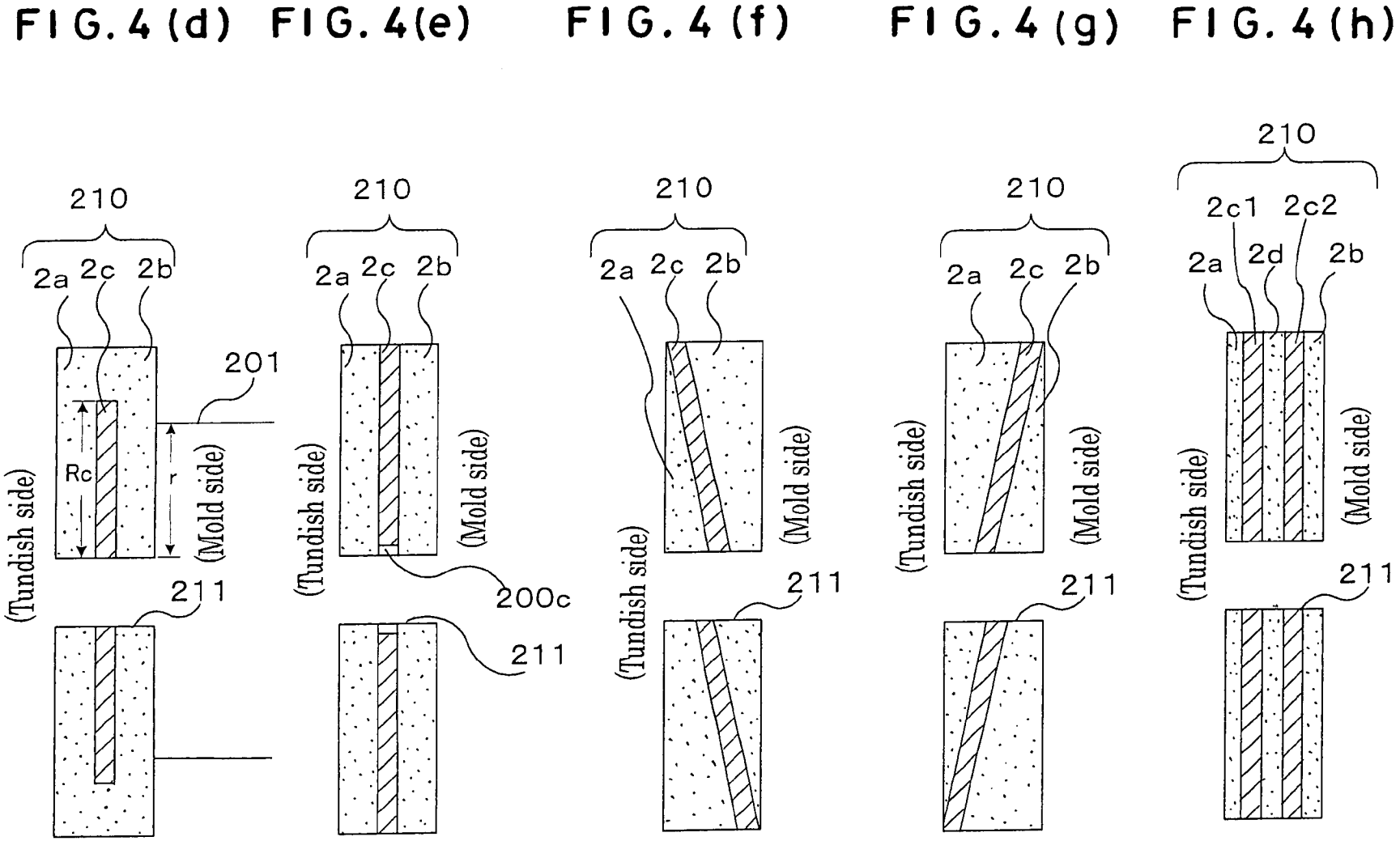
FIG. 4 is a diagram illustrating the refractory plate employed in the present invention.

Next will be described the refractory plate 210. FIG. 3 and FIG. 4 show diagrams illustrating a refractory plate employed in the present invention. The refractory plate 210 is provided between the tundish 250 and the upstream end of the mold 201 and is formed of a refractory, heat-insulation material. As shown in FIG. 3 and FIG. 4, the refractory plate 210 has insulation members 2 (2*a*, 2*b*, 2*d*) each having a molten metal passage 211 defined therein which allows communication between the tundish 250 and the mold 201 and has a separation layer 2*c* (or 2*c*1, 2*c*2) disposed substantially vertically along the insulation members 2 and having an aperture which is in communication with the molten metal passage 211. One or more molten metal passages 211 may be formed in the area of the refractory plate 210 facing the hollow space 200 of the mold 201.

A variety of the refractory plates 210 may be formed by use of separation layers 2*c* of different shapes and arrangements. For example, in FIG. 3(*a*) employing a structure similar to that shown in FIG. 1, the separation layer 2*c* is placed between the first and second insulation members 2*a* and 2*b*, the former facing the tundish 250 and the latter facing the mold 201. In FIG. 3(*b*), the separation layer 2*c* shown in FIG. 3(*a*) has an aperture circumferential portion 20*c* extending from the separation layer 2*c* and bending horizontally toward the upstream end of the mold 201 to form an L-shaped structure. In FIG. 3(*c*), the refractory plate 210 is formed of the second insulation member 2*b* facing the mold 201 and the separation layer 2*c* facing the tundish 250 and has no first insulation member 2*a*.

The separation layer 2*c* in FIG. 4(*d*) has a shape having removed the outer circumferential end portion of the separation layer 2*c* of FIG. 3(*a*) and has its radial direction depth (the length from the wall surface of the molten metal passage 211 to the outer circumferential end of the separation layer) Rc that is about 1.1 or more times the length r from the wall surface of the molten metal passage 211 to the peripheral wall of the hollow space 200 of the mold.

The separation layer 2*c* in FIG. 4(*e*) has a shape having a circumferential part on its aperture side removed by about 1 mm from the wall surface of the molten metal passage 211.

The separation layers 2*c* in FIG. 4(*f*) and FIG. 4(*g*) are formed between the first and second insulation members 2*a* and 2*b* and aslant relative to the molten metal passage center axis.

In FIG. 4(*h*), the separation layer 2*c*1 is provided between the first insulation member 2*a* and a third insulation member 2*d*, and the separation layer 2*c*2 between the third insulation member 2*d* and the second insulation member 2*b*.

The insulation members 2 (2*a*, 2*b*, 2*d*) are formed of a porous material having low thermal conductivity, such as Lumiboard (product of Nichias Corporation), Insural (product of Foseco Ltd.), or Fiber Blanket Board (product of Ibiden Co., Ltd.). Each of these materials has a thermal conductivity of 0.00033 cal/cm sec ° C. or thereabouts. The separation layer 2*c* is formed of a material which prevents passage of a lubricant or a gasified lubricant therethrough. Examples thereof include silicon nitride, silicon carbide, graphite and metal. The material has a thermal conductivity of 0.04 to 0.6 cal/cm sec ° C. or thereabouts.

In the refractory plate 210 having the above structure, in which the insulation members 2 (2*a*, 2*b*, 2*d*) sandwich the separation layer 2*c*, the separation layer 2*c* prevents the lubricant, which has been supplied through the permeable porous material 222 into the mold 201 and then transferred to the second insulation member 2*b*, from reacting with the molten alloy 255 and from entering the tundish 250. This suppresses waste of the lubricant, resulting in reduction in the amount of the lubricant. Therefore, high-speed casting can be performed stably and smoothly with a reduced amount of the lubricant. In addition, there are not produced lubricant reaction products which would otherwise be produced on the wall surface of the insulation members 2 (2*a*, 2*b*, 2*d*) or in the vicinity thereof, resulting in considerable reduction in ingot failure.

Since the second insulation member 2*b* is provided between the upstream end of the mold 201 and the separation layer 2*c*, molten alloy 255 can be supplied to the mold 201 while retaining heat even when the separation layer 2*c* is made of a material which readily removes heat. Therefore, molten alloy 255 (column-shaped molten metal 215) starts to solidify at a predetermined appropriate position within the mold 201, enabling stable casting.

Since the aperture circumferential portion 20*c* of the separation layer 2*c* is bent and extended horizontally to form an L-shaped structure toward the upstream end of the mold 201, as shown in FIG. 3(*b*), the second insulation member 2*b* provided between the upstream end of the mold 201 and the separation layer 2*c* is prevented from coming into contact with the molten alloy 255 even at the periphery facing the molten metal passage 211. Therefore, the lubricant can be reliably prevented from reacting with the molten alloy 255 after passing through the insulation members 2 (2*a*, 2*b*) and also prevented from entering the tundish 250.

In FIG. 4(*d*), since the separation layer 2*c* has its outer circumferential end portion removed and has its radial direction depth Rc set about 1.1 or more times the length r from the wall surface of the molten metal passage 211 to the peripheral wall of the hollow space 200 of the mold, the shape of the separation layer 2*c* formed of a relatively expensive material can be made small and, at the same time, even the small size of the separation layer can sufficiently intercept the lubricant that has been supplied to the mold 201 and then transferred to the second insulation layer 2*b*.

In FIG. 4(*e*), the separation layer 2*c* has a shape having a circumferential part 200*c* on its aperture side removed by about 1 mm from the wall surface of the molten metal passage 211. This is because the effect of the present invention can sufficiently be obtained even in the presence of the removed part of about 1 mm. When the circumferential part of the separation layer 2*c* on its aperture side has been brought into direct contact with the molten metal in the molten metal passage 211 to deteriorate and damage the part, the damaged area is beforehand removed as shown in FIG. 4(*e*), thereby preventing the deterioration of the material of the separation layer 2*c*.

In each of FIG. 4(*f*) and FIG. 4(*g*), since the separation layer 2*c* is provided aslant relative to the molten metal passage center axis, the wall surface temperature distribution on the upstream side of the mold 201 can be controlled to be optimum owing to the slant of the separation layer 2*c* easy to transfer heat and the resultant change in thickness of the second insulation member 2*b*. As a result, it becomes possible to control the state of the vaporized gas pooled in the mold 201, for example.

By providing two stages of separation layers 2*c* in FIG. 4(*h*), the lubricant transfer can be suppressed more infallibly. Provision of the separation layers in more than two stages can further suppress the lubricant transfer with exactitude.

As described above, the separation layer 2*c* may have a structure expanding in the direction suppressing the lubricant transfer and can be formed in the shape of a layer, film, foil or plate, for example.

The material for the separation layer 2*c* in the shape of a layer, film, foil or plate is prepared and brought into contact with the first, second or third insulation member 2*a*, 2*b* or 2*d*, or sandwiched therebetween.

Otherwise, the separation layer 2*c* can be formed on the first insulation member 2*a* etc. by deposition or thermal spraying.

An intermediate layer may be formed between the separation layer 2*c* and the first insulation member 2*a* etc. for the purpose of enhancing adhesion.

A separation layer may be formed combining two or more configurations shown in FIG. 3(*a*) to FIG. 4(*h*), thereby enabling the lubricant transfer to be suppressed with more exactitude.

Figure 5A:
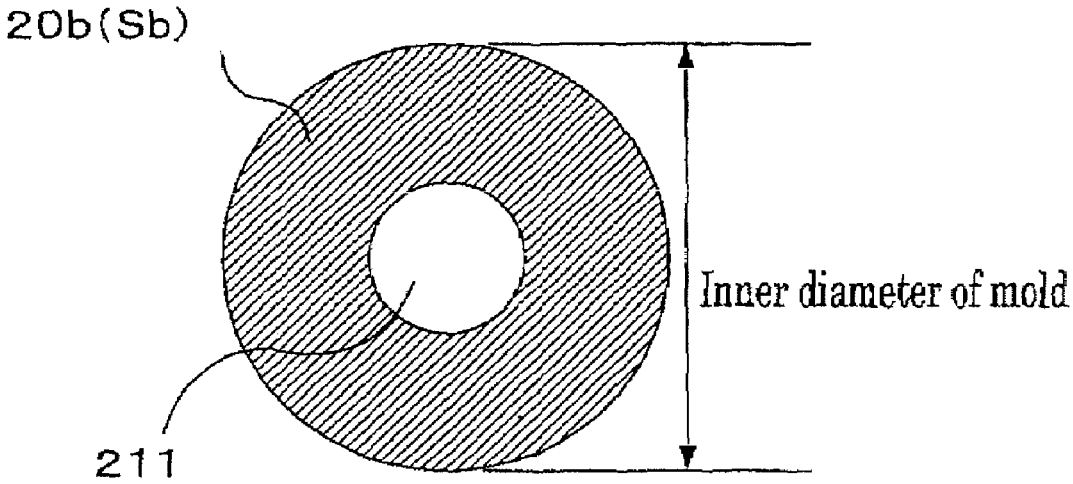
FIG. 5 is a diagram illustrating the area of the second insulation member.
Figure 5B:
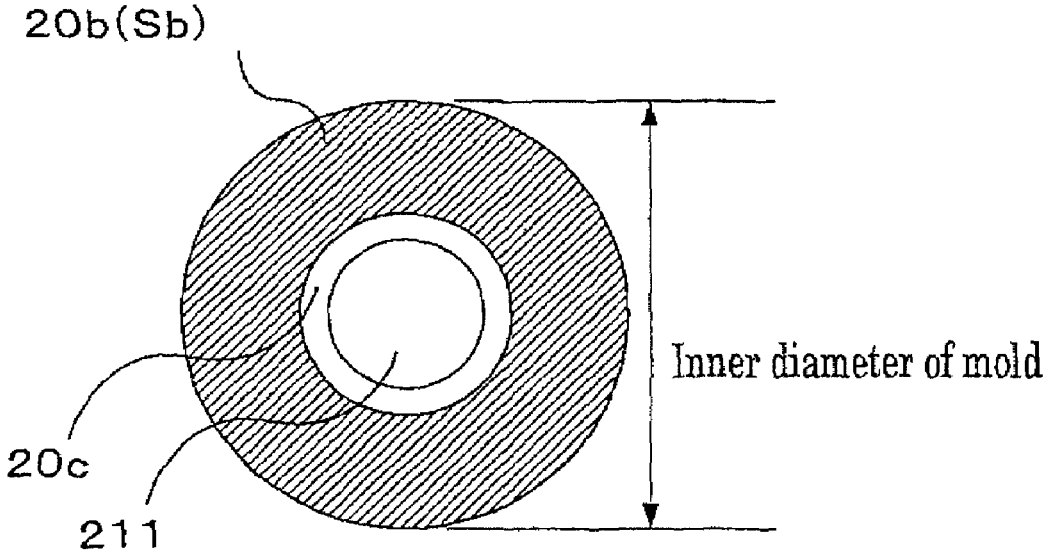

FIG. 5 shows diagrams illustrating the area of the second insulation member. These diagrams depict the second insulation member 2*b* and molten metal passage 211 when seen from the downstream end to the upstream end of the mold 201. In these diagrams described are "inner diameter of insulation member" and "inner diameter of mold" that mean diameters of the insulation member and mold when seen from the downstream end to the upstream end of the mold 201. 2

As described above, the second insulation member 2*b* is provided so as to face the upstream end of the mold 201. In the first embodiment, as shown in FIG. 5(*a*) and FIG. 5(*b*), the area Sb of a portion of the second insulation member 2*b* that faces the hollow space 200 of the mold 201 (i.e., the area of the portion 20*b* of the insulation member 20*b* confirmed when seen from the downstream end to the upstream end of the mold 201) is 40 to 85% of the radial cross-sectional area of the hollow space 200 of the mold 201. FIG. 5(*a*) corresponds to FIG. 3(*a*), FIG. 3(*c*) and FIG. 4(*d*) to FIG. 4(*f*), and FIG. 5(*b*) to FIG. 3(*b*).

As mentioned above, in the first embodiment, since of the second insulation member 2*b* disposed between the upstream end of the mold and the separation layer 2*c*, the insulation member 20*b* that faces the hollow space 200 of the mold 201 has an area Sb that is 40 to 85% of the radial cross-sectional area S0 of the hollow space 200 of the mold 201, it is ensured that an area of the second insulation member 2*b* that is needed for insulation faces the hollow space 200 of the mold 201. Thus, when the molten alloy 255 is supplied to the mold 201, heat of the molten alloy 255 is prevented from being removed at the upstream end of the mold 201 and thus from being cooled. Therefore, molten alloy 255 (column-shaped molten metal 215) starts to solidify at a predetermined appropriate position within the mold 201, enabling stable casting.

The horizontal continuous casting method of the present invention will next be described.

In FIG. 1, molten alloy 255 contained in the tundish 250 flows through the refractory plate 210 to the mold 201 having the mold center axis 220 which is maintained approximately horizontally, and then is forcedly cooled at the exit of the mold 201 to thereby form a solidified ingot 216. The solidified ingot 216 is withdrawn at a predetermined speed by means of a driving apparatus provided in the vicinity of the exit of the mold 201. Thus, the molten alloy 255 is continuously cast to form an aluminum alloy cast bar. The thus produced aluminum alloy cast bar is cut into pieces having a predetermined length by means of a synchronized cutter.

The molten aluminum alloy 255 contained in the tundish 250 may have a composition of, for example, Si (content: 0.05 to 1.3 mass %), Fe (content: 0.10 to 0.70 mass %), Cu (content: 0.1 to 2.5 mass %), Mn (content: 0.05 to 1.1 mass %), Mg (content: 0.5 to 3.5 mass %), Cr (content: 0.04 to 0.4 mass %) and Zn (content: 0.05 to 8.0 mass %). The Mg content is preferred to be 0.8 to 3.5 mass %.

Another example of the composition comprises Si (content: 0.05 to 1.3 mass %), Fe (content: 0.1 to 0.7 mass %), Cu (content: 0.1 to 2.5 mass %), Mn (content: 0.05 to 1.1 mass %), Mg (content: 0.5 to 3.5 mass %), Cr (content: 0.04 to 0.4 mass %) and Zn (content: 0.05 to 8 mass %). The Mg content is preferred to be 0.8 to 3.5 mass %.

The compositional ratio of the alloy of the ingot may be determined through a method as specified in JIS H 1305, which employs a photoelectric photometry-type emission spectrometer (e.g., PDA—5500, product of Shimadzu Corporation, Japan).

Preferably, the difference between the liquid level 254 of the molten alloy 255 contained in the tundish 250 and the uppermost level of the inner wall surface 221 of the mold 201 falls within a range of 0 mm to 250 mm (more preferably, 50 mm to 170 mm). In this range, stable casting can be performed since the molten alloy 255 supplied to the mold 201 is in an appropriate balance, with respect to pressure, with the lubricant and gases produced through gasification of the lubricant.

The liquid lubricant may be a vegetable oil having lubricity. Examples thereof include rapeseed oil, castor oil, and salad oil. These oils provide only small adverse effect on the environment and are therefore preferred.

The amount of the lubricant supplied is preferably 0.05 ml/min to 5 ml/min (more preferably, 0.1 ml/min to 1 ml/min). When the amount is excessively small, insufficient lubricity causes breakout of the solidified ingot 216. When the amount is excessively large, excessive lubricant contaminates the solidified ingot 216, causing formation of internal defects.

The casting speed, at which the solidified ingot 216 is pulled out of the mold 201, is preferably 200 mm/min to 1,500 mm/min (more preferably, 400 mm/min to 1,000 mm/min). In this casting speed range, crystals formed through casting have uniform and fine network structure, and aluminum products obtained through casting have higher resistance to deformation at high temperature, resulting in improved mechanical strength at high temperature.

The amount of the cooling water fed from the cooling water showering apparatus 205 per mold is preferably 10 l/min to 50 l/min (more preferably, 25 l/min to 40 l/min). When the amount of the cooling water is excessively small, breakout may occur, or the surface of the solidified ingot 216 may remelt to thereby form non-uniform metal structures, which may remain as internal defects. When the amount of the cooling water is excessively large, the amount of heat removed through the mold 201 is too large to perform continuous casting.

The mean temperature of the molten alloy 255 supplied from the tundish 250 to the mold 201 is preferably 600° C. to 750° C. (more preferably, 650° C. to 700° C.). When the temperature of the molten alloy 255 is excessively low, large crude crystals are formed in the molten alloy which is solidifying in the mold 201 or prior to entering the mold 201, and the crystals are incorporated into the solidified ingot 216 as internal defects. When the temperature of the molten alloy 255 is excessively high, a large amount of hydrogen gas is incorporated into the molten alloy 255 and then incorporated into the solidified ingot 216 as pores, resulting in internal defects.

Next, the second embodiment of the present invention will be described with reference to FIG. 6, FIG. 7 and FIG. 8.

Figure 6:
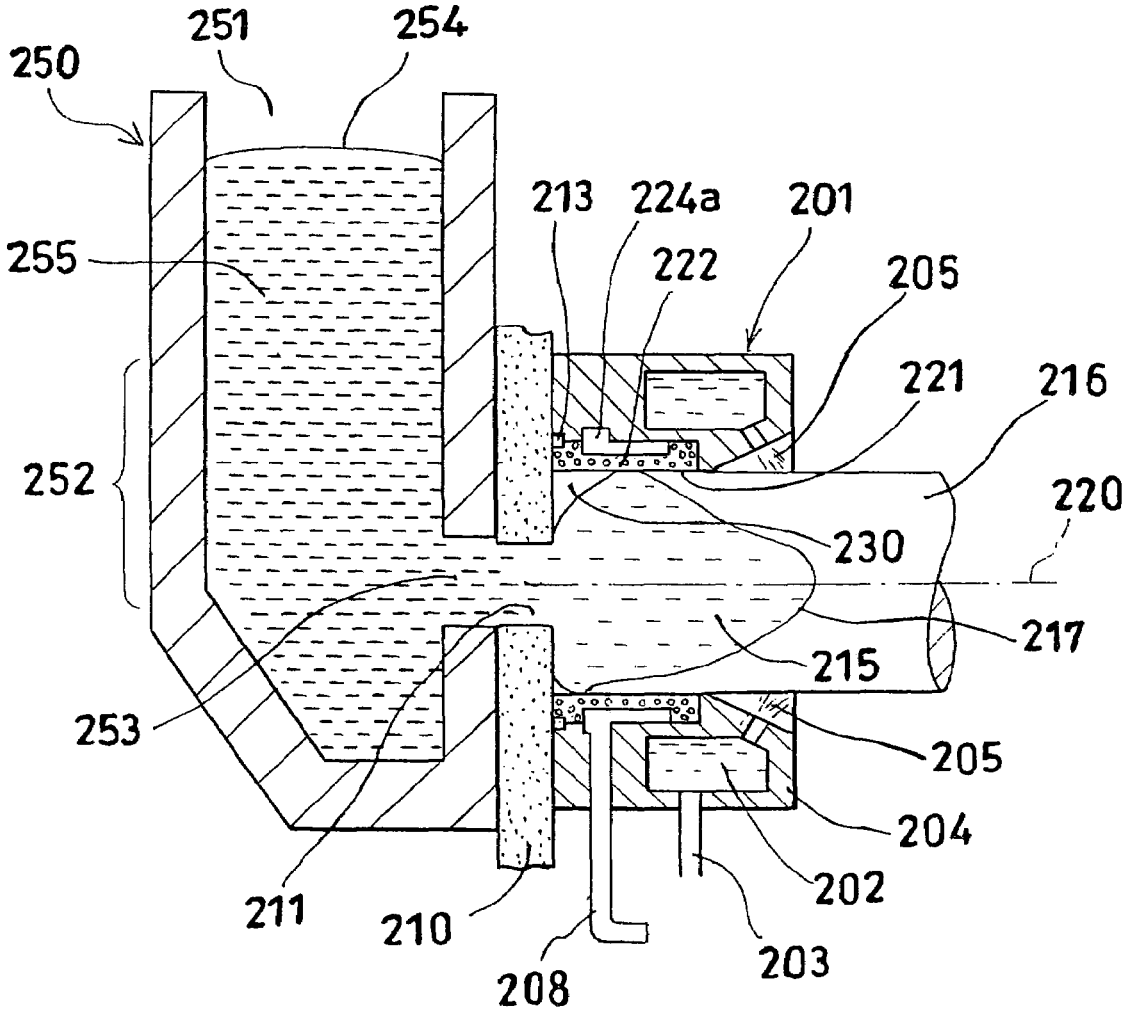
FIG. 6 is a diagram showing the vicinity of the mold of the horizontal continuous casting apparatus in the second embodiment.

FIG. 6 shows the vicinity of a mold of the horizontal continuous casting apparatus according to the second embodiment. FIG. 7 and FIG. 8 show the configurations of lubricant supply portions in the second embodiment. The difference between the first embodiment and the second embodiment resides in the configuration of the lubricant supply portion. In addition, the refractory plate 210 includes no separation layer and is configured only with an insulation member formed of, for example, Lumiboard.

Figure 7A:
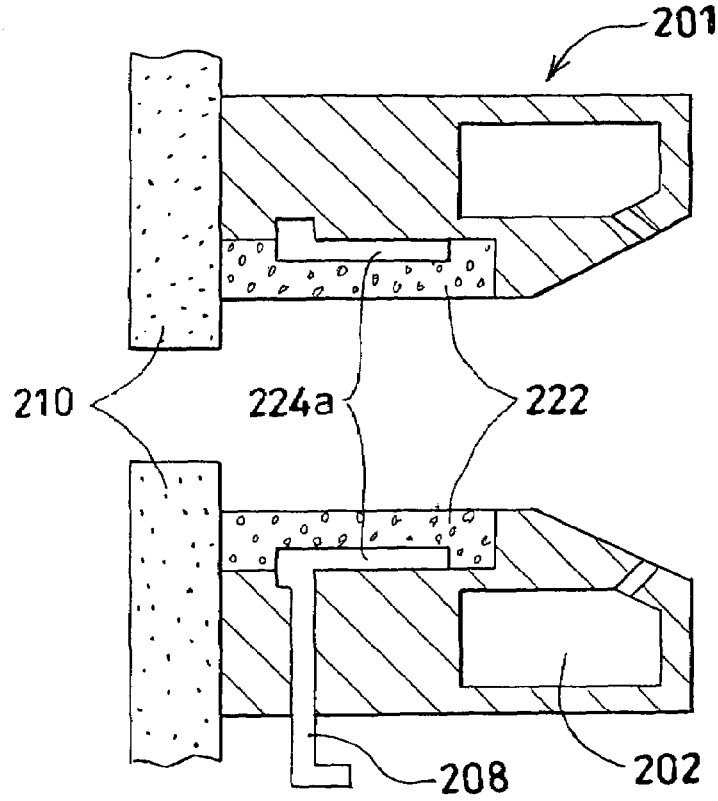
FIG. 7 is a diagram showing configuration of the lubricant supply portion in the second embodiment.
Figure 7B:
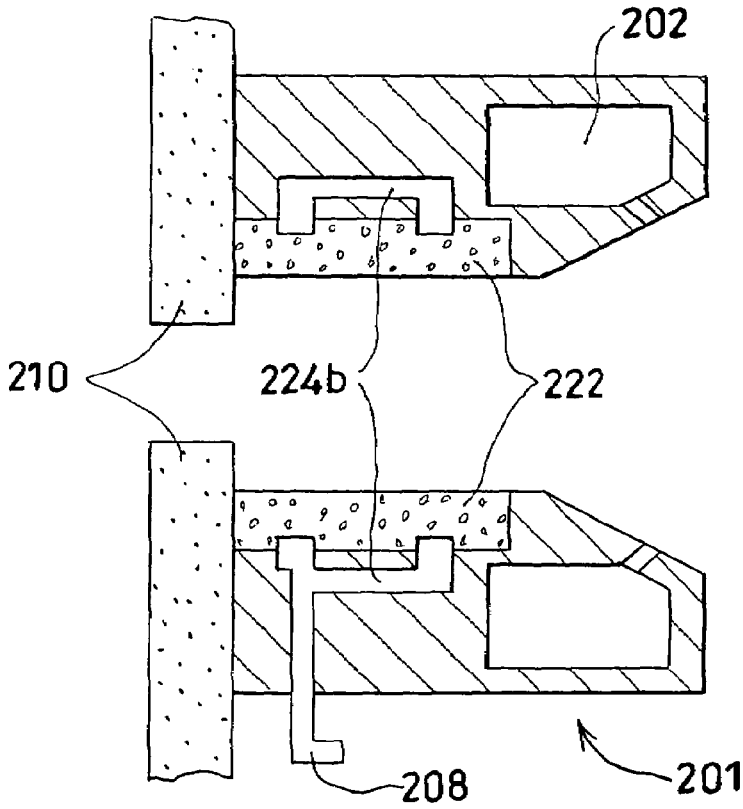

In the second embodiment, as shown in FIG. 6 and FIG. 7(*a*), a lubricant supply conduit 224*a* is provided in the inner wall of the mold at a position proximal to the upstream end of the mold 201 and extended toward the downstream end of the mold 201. The width of the conduit 224*a* as measured in the horizontal direction is, for example, 2 to 13 mm (preferably, 2 to 7 mm.

Since the lubricant supply conduit 224*a* is extended toward the downstream end of the mold 201, the lubricant can also be supplied into the mold at a position of the conduit which is proximal to the downstream end of the mold 201. In the case of high-speed casting, the position where column-shaped molten metal 215 starts to solidify tends to move toward the downstream end of the mold. In order to supply the lubricant to the solidification starting position, conventionally, a greater amount of the lubricant greater than necessary has been supplied into the mold 201 at a position of the conduit proximal to the upstream end of the mold (see the lubricant supply conduit 224*a* in FIG. 1). In the second embodiment, appropriate supply of the lubricant into the mold can be attained through use of the extended portion of the lubricant supply conduit 224*a* which enables supply of the lubricant at a position proximal to the downstream end of the mold. That is, the lubricant is supplied in an appropriate amount to a place in need thereof. Therefore, the lubricant is supplied only in a necessary amount, and thus high-speed casting can be performed stably and smoothly while employing a reduced amount of lubricant.

Alternatively, as shown in FIG. 7(*b*), the lubricant supply conduit 224*b* may be branched so that a branched end thereof is located at a position proximal to the downstream end of the mold. The branch width of the lubricant supply conduit 224*b* (distance one end to the other end of the branched lubricant supply conduits 224*b* in its lengthwise direction) is, for example, 2 to 13 mm (preferably, 2 to 7 mm) similarly to that described above in relation to the extended conduit. Thus, similarly to that described above in relation to the extended lubricant supply conduit 224*a*, the lubricant can be supplied through the branched lubricant supply conduit 224*b* which is proximal to the downstream end of the mold 201. That is, even in high-speed casting, the lubricant is supplied in an appropriate amount to a place in need thereof. Therefore, the lubricant is supplied only in a necessary amount, and thus high-speed casting can be performed stably and smoothly while employing a reduced amount of lubricant.

Figure 8A:
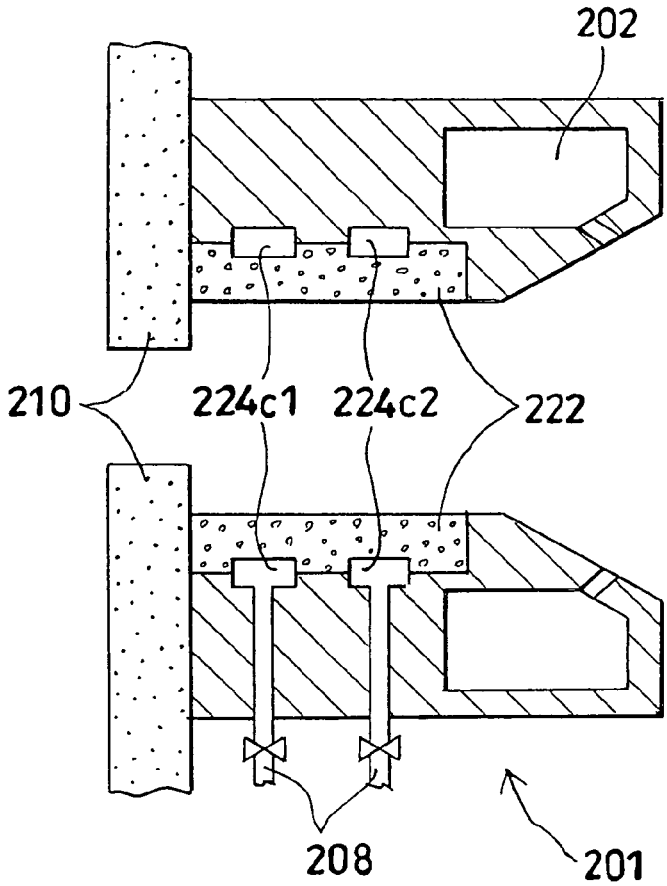
FIG. 8 is a diagram showing configuration of the lubricant supply portion in the second embodiment.
Figure 8B:
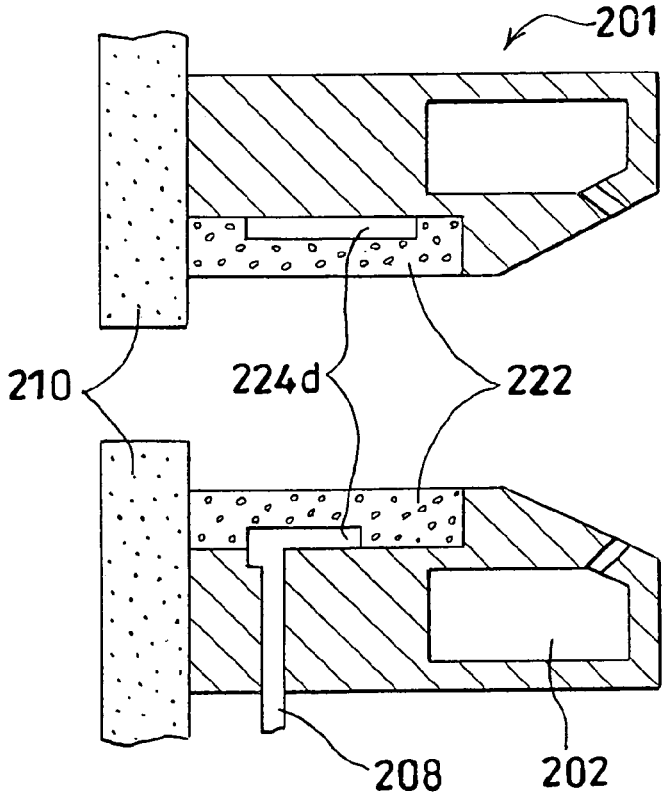

In FIG. 8(*a*), the lubricant supply conduit is separated into two, one 224*c*1 being proximal to the upstream end of the mold and the other 224*c*2 being proximal to the downstream end of the mold, in which the amounts of the lubricant to be supplied from them can be adjusted independently of each other. In this case, the amount of the lubricant to be supplied from either the conduit proximal to the upstream end of the mold or the conduit proximal to the downstream end of the mold can be changed and, therefore, it becomes possible to supply the lubricant in an appropriate amount depending on the supply positions. Thus, the lubricant is supplied only in a necessary amount, and thus high-speed casting can be performed stably and smoothly while employing a reduced amount of lubricant.

Furthermore, in FIG. 8(*b*), the lubricant supply conduit 224*d* is extended toward the downstream end of the mold and, at the same time, the extension width thereof (distance from one end to the other end of the lubricant supply conduit 224*d* in its lengthwise direction) is changed in accordance with the positions thereof in the mold inner wall, with the upper portion thereof made longer and the lower portion thereof made shorter, for example. With the extension width thereof changed, the amount of the lubricant to be supplied is made smaller relative to the lower portion of the exit side (downstream end) of the mold where the column-shaped molten metal 215 starts to solidify earlier and larger relative to the upper portion of the mold, so that an appropriate amount of the lubricant may be supplied in accordance with the positions. That is, the lubricant is supplied only in a necessary amount, and thus high-speed casting can be performed stably and smoothly while employing a reduced amount of lubricant.

A lubricant supply conduit 224 of a combination of two or more of the configurations shown in FIGS. 7(*a*), 7(*b*), 8(*a*) and 8(*b*) may be adopted. As a result, the lubricant can be supplied more appropriately.

The state requiring a treatment with a great amount of a lubricant has recently been reported in order to make a stable producing operation in horizontal continuous casting. On the other hand, a reduction in the amount of a lubricant to be supplied has been required from the standpoints of reduction in operation cost, affection of waste oil disposal on the environment and prevention of quality deterioration by entangling of a lubricant in column-shaped molten metal.

Mere reduction in amount of the lubricant supplied induces twitch flaws on the surface of an ingot, eventually inducing breakout thereon to make it impossible to perform a stable operation The present inventors have found out that it is possible to suppress occurrence of twitch flaws and breakout if an appropriate amount of a lubricant could be supplied to the molten metal in a state in which solidification starts, i.e. in a sherbet state and that particularly in the case of high-speed casting, since the sherbet state in which the molten metal starts to solidify at the upper side of the mold extends to the exist of the mold, homogeneous distribution of the lubricant over the entire surface enables the high-speed operation to be stabilized and a cast bar good in surface quality to be produced and have consequently perfected the present invention.

That is to say, the lubricant supply conduit is improved to enable an appropriate amount of the lubricant to be supplied to a proper place, thereby reducing the amount of the lubricant to be supplied, suppressing occurrence of twitch flaws and breakout and making it possible to stabilize the high-speed operation even when the amount of the lubricant supplied is reduced.

When the diameter of a cast bar to be produced is changed, conditions have to be stipulated anew at the start of operation. This will make the productivity worse. When the amount of the lubricant is changed, the balance between the lubricant-vaporized gas pressure and the head pressure has to be re-adjusted. This will make the operation instable. These problems could be solved through the improvement in the lubricant supply conduit according to the present invention that enables an appropriate amount of lubricant to be supplied to a proper place. That is to say, the configuration of the lubricant supply conduit of the present invention enables the following effects to be manifested.

①The amount of lubricant to be supplied can totally be reduced and, as a result, transfer of the lubricant to the cast ingot can be suppressed to enable a high-speed operation.

②Even when the diameter of a cast bar to be produced is changed, it is unnecessary to re-adjust the amount of a lubricant to be supplied, thus enabling a stabilized operation to be made with ease even in the case of a high-speed operation.

The position and length of the lubricant supply conduit are defined in the present invention to be proximal to the downstream end of the mold. The "proximity to the downstream end" used herein can be determined in the following, for example.

The temperatures at various portions of a mold are monitored to find a portion at which the temperature rises abruptly, compared with the temperature of the mold exit. The portion at which the temperature rises abruptly is regarded as a position "proximal the downstream end," the region from the mold entrance to the portion is estimated to be in a sherbet state, and the supply conduit is provided as extending to the position "proximal to the downstream end" so as to cover the region.

In the case of horizontal continuous casting, since the molten metal at the lower portion of the mold exit has already solidified, it is preferred not to provide the lubricant supply conduit at such a portion. In other words, it is preferred that the width of the upper lubricant supply conduit is made larger than that of the lower one. For example, a lubricant supply conduit made smaller continuously from the upper side to the lower side of the mold is used. Alternatively, an upper half of a lubricant supply conduit is only provided on the side of the mold exit.

Next the third embodiment of the present invention will be described with reference to FIG. 9.

Figure 9:
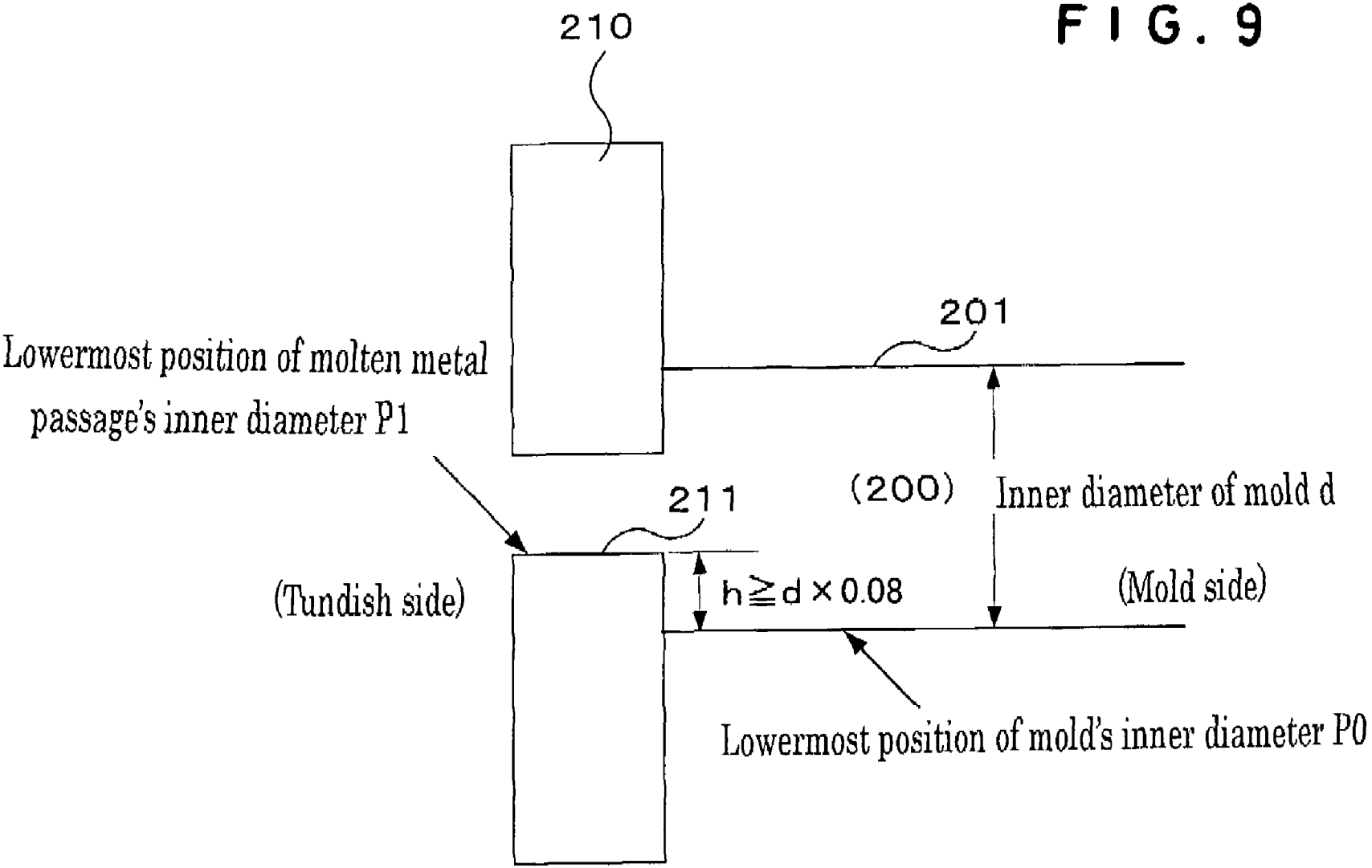
FIG. 9 is a diagram illustrating the position of the molten metal passage in the third embodiment.

FIG. 9 is a diagram illustrating the position of the molten metal passage in the third embodiment. The third embodiment differs from the first embodiment in that the position of the molten metal passage 211 (molten metal supply port) is defined specifically. In addition, the refractory plate 210 includes no separation layer and is configured only with an insulation member formed of, for example, Lumiboard.

As shown in FIG. 9, in the third embodiment, the relationship between the molten metal passage 211 and the mold 201 is defined such that the lowermost position P1 of the inner wall of the molten metal passage is located at a position higher by the height h than the lowermost position P0 of the inner wall of the mold, the height h being equal to or larger than 8% (preferably, equal to or larger than 10%) of the inner diameter d of the mold.

Though the upper limit of the definition of the height h of the lowermost position P1 of the inner wall of the molten metal passage is not particularly limited, it is a point where the thermal balance between the upper and lower parts of the mold is lost to fail to form a solidifying shell or a point where the center position of the cross-sectional shape of the molten metal passage (molten metal port) is not higher than the center position of the cross-sectional shape of the hollow space of the mold or a point where the shape is determined by position. For example, the upper limit from the lowermost position P0 of the inner wall of the mold is equal to or smaller than 30% (preferably, equal to or smaller than 25%) of the inner diameter d of the mold.

By defining the height h of the molten metal passage 211 as described above, since the lower positional limit of the molten metal passage has a constant height unlike in the conventional case where the molten metal passage 211 is provided at the lowermost portion of the inner wall of the mold so as to form uniform temperature distribution in the formed ingot, the molten metal flows from the height into the mold and is deprived of heat until it reaches the lowermost portion of the mold. Since the conventional positioning method does not consider that the molten metal is deprived of heat until it reaches the lowermost portion of the mold, when the amount of the lubricant has to be re-adjusted because of the change in casting diameter and molten metal temperature, the conditions for stabilizing the operation are difficult to change.

Since the height h of the molten metal passage 211 is defined in the present invention, the temperature of the molten alloy which is supplied to the lower part of the upstream end of the mold 201 is decreased to enable rapid solidifying shell formation in the lower part of the ingot. Thus, casting can stably be performed even with a decreased amount of the lubricant. Therefore, high-speed casting can be performed stably and smoothly while the amount of the lubricant is reduced. Further, since the temperature of the molten alloy supplied to the lower part of the upstream end of the mold is lowered, gasification of the lubricant can be suppressed, preventing failure ingot which may otherwise be caused by incorporation of gasified lubricant.

Even when the amount of lubrication oil is to be re-adjusted owing to the change in casting diameter, molten oil temperature, etc., since the amount of lubrication oil (lubricant) is reduced, a small range of control will suffice to make the conditions easy to change.

As described above, in any of the first, second and third embodiments of the present invention, horizontal continuous casting can be stably performed even when the amount of the lubricant supplied is reduced, and high-speed casting can be performed even when the amount of the lubricant is reduced. Conventionally, casting of an aluminum alloy containing magnesium has been difficult to perform stably without increasing the amount of the lubricant, due to the presence of highly active magnesium. In the present invention, even in casting of an aluminum alloy containing magnesium in a large amount of 0.5 mass % or more (preferably, 0.8 mass % or more), similar effects as described above in relation to high-speed casting can be exhibited, including reduction in the amount of the lubricant, prevention of occurrence of lubricant reaction products, stable and smooth casting, and prevention of occurrence of ingot failure.

While the application of the present invention to horizontal continuous casting apparatus has been described in the foregoing, use of the separation layer, insofar as it has a configuration in which an insulation member interposes between a molten metal-receiving portion and a mold, is not limited to the horizontal continuous casting apparatus, but is also adopted similarly in a vertical continuous casting apparatus. One example of the present invention applied to a vertical continuous casting apparatus will be described with reference to FIG. 10.

Figure 10:
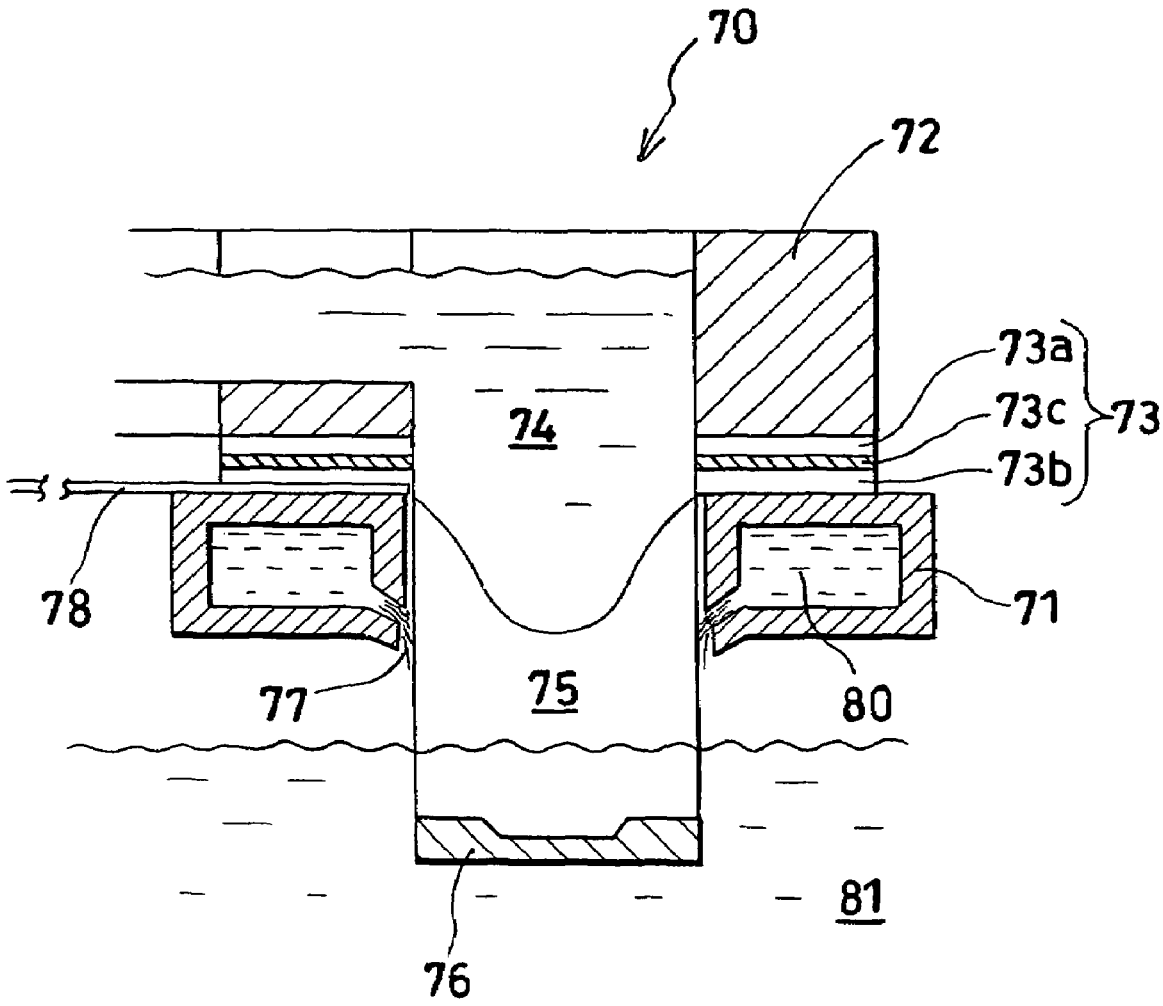
FIG. 10 is a diagram schematically showing the hot top casting apparatus to which the present invention is applied.

FIG. 10 schematically shows showing a hot top casting apparatus to which the present invention is applied. The hot top casting apparatus 70 is equipped with a water-cooled mold 71 and a molten metal-receiving portion (header) 72 of refractory material disposed above the water-cooled mold 71. Between the water-cooled mold 71 and the header 72 is disposed a refractory plate 73 comprising a first insulation member 73*a*, a second insulation member 73*b* and a separation layer 73*c* between the two insulation members. A molten aluminum alloy 74 is supplied directly into the water-cooled mold 71 unlike the spout supply system adopted in other DC continuous casting apparatus. The water-cooled mold 71 is cooled with cooling water 80. The molten aluminum alloy 74 introduced in a groove of the water-cooled mold 71 forms a solidifying shell in a contracted state at the portion thereof in contact with the inner circumferential wall of the water-cooled mold 71, and a solidified aluminum alloy ingot 75 is withdrawn downward from the water-cooled mold 71 with a downwardly moving lower mold 76. At this time, the aluminum alloy ingot 75 is cooled with a jet of cooling water 77 supplied from the water-cooled mold 71, and the lower part of the aluminum alloy ingot 75 is immersed in water 81 in a water vessel to be further cooled, thereby being completely solidified. When the lower mold 76 reaches the lower limit of its movable range, the aluminum alloy ingot 75 becomes a cast bar that is cut at a prescribed position into pieces to be taken out.

In the hot top casting apparatus 70, since no adjustment with respect to a flow from the spout is required at a start of casting and the mold length can be made short, the surface of a cast bar produced can be made smooth, which is preferable. In addition, since casting is performed with a horizontal level maintained with the upper end face of the lower mold 76, there is little turbulence in the molten metal, leading to acquirement of a better effect of texture refinement.

A lubrication oil is supplied from a lubrication oil supply conduit 78 provided between the refractory plate 73 and the water-cooled mold 71 to prevent seizure of the molten aluminum alloy 74 or cast aluminum alloy ingot 75 on the inner peripheral wall of the water-cooled mold 71. Furthermore, in the hot top casting apparatus 70, since the refractory plate 73 is provided with the separation layer 73*c*, the lubrication oil having been transferred to the refractory plate 73 can be intercepted with the separation layer 73*c*, consumption of the lubrication oil that is of no use can be suppressed.

The present invention is also applicable to a gas pressurized type hot top casting apparatus that is an improvement in an ordinary hot top casting apparatus.

Although the first, second and third embodiments are worked independently in the above description, these embodiments may be combined arbitrarily. An optional combination, such as that of the first and second embodiments or that of the first and third embodiment, can exhibit the above effects, such as reduction in the amount of the lubricant, more clearly.

The second embodiment is combined with the first or third embodiment, with the second embodiment as a primary role.

Otherwise, the third embodiment is combined with the first or second embodiment, with the third embodiment as a primary role. Any of these combinations can considerably exhibit the various effects, such as reduction in the amount of the lubricant.

Examples 1 to 12 and Comparative Examples 1 to 3 were worked in order to mainly confirming the effect of a separation layer. Here, the frequency of occurrence of twitch flaws and the occurrence status of transferring a lubrication oil to an insulation member were evaluated, with the Mg content in an aluminum alloy, diameter of a cast bar, amount of the lubrication oil, casting speed and separation layer varied.

A 6061 alloy was used as the aluminum alloy, and a molten alloy was adjusted to have a composition comprising 0.6% of Si, 0.2% of Fe, 0.3% of Cu, 0.05% of Mn, 0.05% of Cr, 0.1% of Ti and Mg, with the Mg content set to be 0.8% and 1.5%, respectively.

Two kinds of cast bars were produced, one having a diameter of 30 mm and the other having a diameter of 60 mm. The extended lubricant supply conduit shown in FIG. 7(*a*) was used, with the extended horizontal length thereof set to be 4 mm.

The area Sb of a part 20*b* of a second insulation member 2*b* intervening between the upstream end of a mold 201 and a separation layer 2*c*, which part faces the hollow space 200 of the mold 201, was set to be 75% with respect to a radial cross-sectional area of the hollow space of the mold 201.

The separation layers shown in FIGS. 3(*a*), 3(*b*) and 3(*c*), FIGS. 4(*d*) to 4(*f*) and FIG. 4(*h*) were used. The separation layer used in each of Examples 1 to 11 had a thickness of 1 mm and was formed of silicon nitride. The second insulation member in contact with the mold had a thickness of 1 mm. The separation layer used in Example 12 was formed of metal, specifically nickel foil (with a thickness of 0.1 mm).

The amount of lubrication oil reduced during the casting was weighed out and the weighed-out amount was fed back with a personal computer to thereby adjust the amount of lubrication oil to be introduced in chronological order.

The number of occurrence of twitch flaws (frequency of occurrence of twitch flaws was expressed as the length of twitch flaws per m of a cast bar in 20 minutes from the start of casting (number of twitch flaws×length (m)). Thus, the unit thereof becomes m/m.

The cross section of the refractory member (insulation member) in the direction of withdrawing an ingot was observed, and the occurrence status of transferring a lubrication oil to the member was expressed as a rate of area of a part carbonized. Casting was performed, with the temperature of molten alloy in the tundish made constant at 700° C.

The results of Examples 1 to 12 and Comparative Examples 1 to 3 worked under the various conditions mentioned above are shown in Table 1 below.

TABLE 1

| Ex. | Mg content (%) | Cast bar Ø mm | Amount of lubricant g/min | Casting speed mm/min | Separation layer | Number of occurrence of twitch flaws m/m | Rate of transfer of lubricant % | Total evaluation |
|---|---|---|---|---|---|---|---|---|
| Ex. 1 | 0.80 | 30 | 0.15 | 700 | 3(a) | None | 7 | ○ |
| Ex. 2 | 0.80 | 30 | 0.40 | 700 | 3(a) | None | 8 | ○ |
| Ex. 3 | 1.50 | 30 | 0.20 | 700 | 3(a) | None | 8 | ○ |
| Ex. 4 | 0.80 | 60 | 0.20 | 700 | 3(a) | None | 8 | ○ |
| Ex. 5 | 0.80 | 30 | 0.15 | 1200 | 3(a) | None | 7 | ○ |
| Ex. 6 | 0.80 | 30 | 0.15 | 700 | 3(b) | None | 4 | □ |
| Ex. 7 | 0.80 | 30 | 0.15 | 700 | 3(c) | None | 7 | ○ |
| Ex. 8 | 0.80 | 30 | 0.15 | 700 | 4(d) | None | 7 | ○ |
| Ex. 9 | 0.80 | 30 | 0.15 | 700 | 4(e) | None | 10 | ○ |
| Ex. 10 | 0.80 | 30 | 0.15 | 700 | 4(f) | None | 7 | ○ |
| Ex. 11 | 0.80 | 30 | 0.15 | 700 | (4h) | None | 7 | ○ |
| Ex. 12 | 0.80 | 30 | 0.15 | 700 | 3(a)metal | None | 7 | ○ |
| Comp. Ex. 1 | 0.80 | 30 | 0.15 | 700 | None | 4 | 43 | X |

TABLE 1-continued

| Ex. | Mg content (%) | Cast bar Ø mm | Amount of lubricant g/min | Casting speed mm/min | Separation layer | Number of occurrence of twitch flaws m/m | Rate of transfer of lubricant % | Total evaluation |
|---|---|---|---|---|---|---|---|---|
| Comp. Ex. 2 | 0.80 | 30 | 0.20 | 700 | None | 1 | 45 | X |
| Comp. Ex. 3 | 0.80 | 30 | 0.40 | 700 | None | None | 50 | X |

In Example 1 having a separation layer, no twitch flaw occurs in spite of the amount of lubrication oil that is 37% based on the amount thereof (0.40 g/min) in Comparative Example 3 in which no twitch flow occurs. The rate of 7% of transfer of lubricant in Example 1 is reduced by 86% based on 50% in Comparative Example.

In Example 2 using the same amount of lubrication oil as in Comparative Example 3, the rate of transfer of lubricant is nearly equal to that in Example 1, and excessive amount of lubricant was dropped out of the system via the insulation member in contact with the mold.

In either Example 3 in which the Mg content was increased to 1.5% or Example 4 in which the cast bar diameter was increased to 60 mm and in both Examples 3 and 4 in which the amount of lubrication oil introduced was increased to 0.20 g/min compared with Example 1, no twitch flaw occurred and the rate of transfer of lubricant was nearly equal to that in Example 1. In Example 5 in which the casting speed was increased to 1200 mm/min, casting could be completed without inducing any problem in spite of the amount of lubricant introduced being 0.15 g/min.

Examples 6 to 12 use different kinds of separation layers, and the effect of the rate of transfer of lubricant in Example 6 was the minimum and the best while those of the remaining Examples were equal or nearly equal to that of Example 1.

It was found that provision of a separation layer could reduce the amount of lubrication oil to be introduced and prevent transfer of the oil resulting in occurrence of twitch flaws and black sludge.

Examples 13 to 20 were worked to confirm the effect of the area of an insulation member. Evaluation was made with respect to the relationship of the area ratio of the insulation member relative to the amount of the lubrication oil immediately before occurrence of twitch flaws and to the rate of transfer of the oil.

The area ratio was obtained by dividing the area of the second insulation member facing the hollow space of the mold by the radial cross-sectional area of the hollow space of the mold. In these Examples, the hollow space of the mold has a circular cross section having a diameter of 30 mm.

A 6061 alloy was used as the aluminum alloy in the same manner as in Examples 1 to 12, and the molten alloy was adjusted to have a composition comprising 0.6% of Si, 0.2% of Fe, 0.3% of Cu, 0.05% of Mn, 0.05% of Cr, 0.1% of Ti and 0.8% of Mg.

Two kinds of cast bars were produced, one having a diameter of 30 mm and the other having a diameter of 60 mm. The extended lubricant supply conduit shown in FIG. 7(*a*) was used, and the extended horizontal length thereof was set to be 4 mm.

The area Sb of a part 20*b* of a second insulation member 2*b* intervening between the upstream end of a mold 201 and a separation layer 2*c*, which part faces the hollow space 200 of the mold 201, was set to be 75% with respect to a radial cross-sectional area of the hollow space 200 of the mold 201.

The separation layers shown in FIG. 3(*a*) and FIG. 3(*b*) were used. The separation layers used had a thickness of 1 mm and was formed of silicon nitride.

The molten metal passage (molten metal supply conduit was disposed in position so that the center thereof is at a center position of the radial cross section of the mold. The casting temperature (temperature of the molten alloy in the tundish) was set at 700° C., and the casting speeds were 700 mm/min and 1200 mm/min, respectively.

The amount of the lubrication oil to be introduced was gradually reduced while observing the casting surface during the casting, and measured when twitch flaws start occurring, thereby determining the amount thereof allowing twitch flaws not to occur.

The results of Examples 13 to 20 performed under the various conditions mentioned above are shown in Table 2 below.

TABLE 2

| Ex. | Cast Bar Ø mm | Casting speed mm/min | Separation layer | Molten metal conduit diameter mm | Insulation member area $mm^2$ | Insulation member area ratio % | Amount of lubricant supplied at occurrence of twitch flaws g/min | Rate of transfer of lubricant % |
|---|---|---|---|---|---|---|---|---|
| Ex. 13 | 30 | 700 | 3(a) | 9.0 | 643 | 91 | 0.10 | 9 |
| Ex. 14 | 30 | 700 | 3(a) | 12.0 | 594 | 84 | 0.10 | 8 |
| Ex. 15 | 30 | 700 | 3(a) | 15.0 | 530 | 75 | 0.12 | 7 |

TABLE 2-continued

| Ex. | Cast Bar Ø mm | Casting speed mm/min | Separation layer | Molten metal conduit diameter mm | Insulation member area $mm^2$ | Insulation member area ratio % | Amount of lubricant supplied at occurrence of twitch flaws g/min | Rate of transfer of lubricant % |
|---|---|---|---|---|---|---|---|---|
| Ex. 16 | 60 | 1200 | 3(a) | 15.0 | 530 | 75 | 0.12 | 7 |
| Ex. 17 | 30 | 700 | 3(a) | 17.0 | 480 | 68 | 0.13 | 7 |
| Ex. 18 | 30 | 700 | 3(a) | 20.0 | 393 | 56 | 0.14 | 7 |
| Ex. 19 | 30 | 700 | 3(b) | 20.0 | 327 | 46 | 0.14 | 4 |
| Ex. 20 | 30 | 700 | 3(a) | 23.5 | 273 | 39 | 0.20 | 15 |

When the area ratio of a part of the second insulation member intervening between the upstream end of the mold and the separation member, which part faces the hollow space of the mold was reduced to less than 40 in Example 20, the vaporized gas within the mold flows toward the tundish to generate gas bubbles, followed by an increase to 15% in rate of transfer of lubricant.

Though the area ratio of the insulation layer was 84% in Example 14, the amount of lubrication oil introduced at the occurrence of twitch flaws was the minimum.

Though the area ratio of the insulation layer was 91% in Example 13, since the molten metal supply conduit had a smaller diameter, the amount of molten alloy supplied could not catch up with the amount of molten alloy discharged, resulting in instable casting.

It was found that by setting the area ratio of a part of the second insulation member intervening between the upstream end of the mold and the separation layer, which part faces the hollow space of the mold, to be 40 to 84%, the amount of the lubrication oil to be introduced and the amount of the oil transferred to the insulation member could be the minimum.

Examples 101 to 116 and Comparative Example were worked to confirm the effect of the extension. Here, the diameter of the cast bar, the kind and length of the lubrication oil supply conduit and the separation layer were modified to evaluate the minimum amount of lubrication oil allowing the twitch flaws to occur and the casting speed limit allowing breakout to occur.

A 6061 alloy was used as the aluminum alloy, and the molten alloy was adjusted to have a composition comprising 0.6% of Si, 0.2% of Fe, 0.3% of Cu, 0.05% of Mn, 0.05% of Cr, 0.1% of Ti and 1.0% of Mg. Two kinds of cast bars having a diameter of 30 mm and a diameter of 60 mm were produced.

The separation layer shown in FIG. 3(*b*), formed of silicon nitride and having a thickness of 1 mm was used. The thickness of the second insulation member in contact with the mold was 1 mm.

The area ratio Sb of a part of the second insulation layer intervening between the upstream end of the mold and the separation layer, which part faces the hollow space of the mold, was set to be 75% relative to the longitudinal cross-sectional area S0 of the hollow space of the mold.

The casting speed was set to be 400 mm/min to 1500 mm/min, and the casting temperature (temperature of the molten alloy within the tundish) be 700° C. The molten metal passage (molten metal supply conduit) was set in position so that the center thereof is at the center of the longitudinal cross section of the mold.

Extended lubricant supply conduits shown in FIGS. 7(*a*), 7(*b*) and 8(*b*) were used, and the extended horizontal length was set to be 2 mm to 13 mm.

The results of Examples 101 to 116 and Comparative Example performed under the various conditions mentioned above are shown in Table 3 below.

TABLE 3

| Ex. | Cast bar Ø mm | Lubricant supply conduit kind and length | Separation layer | Amount of lubricant supplied at occurrence of twitch flaws g/min | Limit of casting speed |
|---|---|---|---|---|---|
| Ex. 101 | 30 | 7(a) 2 mm | (b) | 0.18 | 1000 mm/min |
| Ex. 102 | 30 | 7(a) 4 mm | (b) | 0.15 | 1300 mm/min |
| Ex. 103 | 30 | 7(a) 7 mm | (b) | 0.13 | 1500 mm/min |
| Ex. 104 | 30 | 7(a) 10 mm | (b) | 0.13 | 1500 mm/min |
| Ex. 105 | 30 | 7(a) 13 mm | (b) | 0.13 | 1500 mm/min |
| Ex. 106 | 30 | 7(b) | (b) | 0.14 | 1400 mm/min |
| Ex. 107 | 30 | 8(b) | (b) | 0.15 | 1300 mm/min |
| Ex. 108 | 30 | 8(b) | (b) | 0.14 | 1400 mm/min |
| Ex. 109 | 30 | 7(a) 4 mm | None | 0.22 | 1300 mm/min |
| Ex. 110 | 30 | 7(a) 1 mm | (b) | 0.26 | 800 mm/min |
| Ex. 111 | 60 | 7(a) 2 mm | (b) | 0.18 | 600 mm/min |
| Ex. 112 | 60 | 7(a) 4 mm | (b) | 0.15 | 800 mm/min |
| Ex. 113 | 60 | 7(a) 7 mm | (b) | 0.13 | 1000 mm/min |
| Ex. 114 | 60 | 7(b) | (b) | 0.14 | 900 mm/min |
| Ex. 115 | 60 | 8(b) | (b) | 0.15 | 800 mm/min |
| Ex. 116 | 60 | 8(b) | (b) | 0.14 | 900 mm/min |
| Com. Ex. | 60 | 7(a) 1 mm | (b) | 0.28 | 400 mm/min |

The lubrication oil supply conduits used in Examples 106 and 114 were of a branched type shown in FIG. 7(*b*), in which the length thereof on one side (entrance side) was 2 mm, the length thereof on the other side (exit side) was 2 mm and the interval between the two was 2 mm.

The lubrication oil supply conduits used in Examples 107 and 115 were of a type having upper and lower ones of different lengths shown in FIG. 8(*b*), in which the upper one has a length of 4 mm and the lower one has a length of 2 mm.

Also, the lubrication oil supply conduits used in Examples 108 and 116 were of a type having upper and lower ones of different lengths shown in FIG. 8(*b*), similarly to Examples 107 and 115, in which the upper one has a length of 6 mm and the lower one has a length of 3 mm.

When the lengths of the lubrication oil supply conduits were increased in Examples 101 to 105, the casting speed limit allowing breakout to occur was increased. In the case of the lubrication oil supply conduit having a length of 1 mm, the amount of lubrication oil allowing twitch flaws to occur is large. While the length of the lubrication oil supply conduits in Examples 104 and 105 are as large as 10 mm and 13 mm, respectively, no effect was obtained in terms of an increase in casting speed. Therefore, it was found that the optimal range of the length of the lubrication oil supply conduit was 2 to 7 mm.

Use of the lubrication oil supply conduits in Examples 106 to 108 could acquire similar effects.

In comparison of the casting bars having a diameter of 30 mm with those having a diameter of 60 mm, the casting speed limits of the bars of 60-mm diameter were relatively lowered due to the thermal capacity while the trend thereof is similar to that of the bars of 30-mm diameter.

In order to suppress the lubrication oil from being transferred from the side facing the mold toward the insulation member, it is totally required to reduce the amount of lubrication oil to be supplied. In the case of high-speed casting, however, failure to supply a great amount of lubrication oil allows twitch flaws to occur on the surface of an ingot and, in the worst case, breakout to occur. The occurrence will be conspicuous when the molten alloy contains 8% or more of Mg. In order to suppress occurrence of twitch flaws on the ingot surface and of breakdown, it has been found that it is necessary to facilitate formation of a solidifying shell on the ingot surface and secure the lubricity efficiency by the lubrication oil. That is to say, it has been found that the cooling can be facilitated and the lubricity efficiency can be secured by allowing the ingot surface solidified thinly within the mold and introducing into the mold the lubrication oil cooled via the mold into a sherbet state. Particular in the case of high-speed casting, it has been found that the sherbet state on the upper side of the mold propagates to the exit of the mold. By uniformly distributing the lubrication oil, stable high-speed operation and good ingot surface quality have been made possible.

Examples 201 to 216 and Comparative Examples 201 and 202 were worked in order to confirm the effect of the prescription of the position of the molten metal passage (molten metal supply conduit). To be specific, it was confirmed through the following test that it was possible to suppress occurrence of twitch flaws and breakout in consequence of formation of a solidifying shell within the mold from the lower portion of the mold by changing the lower limit position of the molten alloy passage.

The minimum amount of lubrication oil that would allow twitch flaws to occur when changing a cast bar diameter, casting speed, separation layer, molten alloy passage diameter and molten alloy passage position, and the rate of transfer of the lubrication oil when allowing twitch flaws to occur were evaluated.

A 6061 alloy was used as the aluminum alloy, and the molten alloy was adjusted to have a composition comprising 0.6% of Si, 0.2% of Fe, 0.3% of Cu, 0.05% of Mn, 0.05% of Cr, 0.1% of Ti and 0.8% of Mg. Two kinds of cast bars having a diameter of 30 mm and a diameter of 60 mm were produced.

The extended lubricant supply conduit shown in FIG. 7(*a*) was used, and the extended horizontal length thereof was set to be 4 mm.

The separation layer shown in FIG. 3(*a*) was used. The separation layer used had a thickness of 1 mm and was formed of silicon nitride. The thickness of the second insulation member in contact with the mold was set to be 1 mm.

A circular molten alloy passage was adopted in each of Examples 201 to 213, whereas a lower semicircular alloy passage in each of Examples 214 to 216. The area ratio of the part of the second insulation member facing the hollow space of the mold was set to be 75% in each of Examples 201 to 206. The position of the molten alloy passage was evaluated based on the rate of the lower position of the inner wall of the molten metal passage allowing communication between the tundish and the mold to the inside diameter of the mold so as not to rely on the cast bar diameter.

The casting temperature (temperature of molten alloy within the tundish) was set to be 700° C., and the casting speed 700 to 1200 mm/min.

With respect to the minimum amount of the lubrication oil constituting the limit of allowing twitch flaws to occur, the amount of the lubrication oil when the twitch flaws started occurring was measured.

The cross section of the refractory member (insulation member) in the direction of withdrawing an ingot was observed, and the occurrence status of transferring a lubrication oil to the member was expressed as a rate of area of a part carbonized.

The results of Examples 201 to 216 and Comparative Examples 201 and 202 performed under various conditions are shown in Table 4 below.

TABLE 4

| Ex. | Cast bar diameter mm | Casting speed mm/min | Kind of separation layer | Molten metal passage diameter mm | Position of molten metal passage % | Amount of lubricant supplied at occurrence of cramp scratches g/min | Rate of transfer of lubricant % |
|---|---|---|---|---|---|---|---|
| Ex. 201 | 30 | 1200 | 3(a) | 15.0 | 25 | 0.12 | 7 |
| Ex. 202 | 30 | 1200 | None | 15.0 | 25 | 0.14 | 20 |
| Ex. 203 | 30 | 1200 | 3(a) | 15.0 | 20 | 0.12 | 7 |
| Ex. 204 | 30 | 1200 | 3(a) | 15.0 | 15 | 0.14 | 8 |

TABLE 4-continued

| Ex. | Cast bar diameter mm | Casting speed mm/min | Kind of separation layer | Molten metal passage diameter mm | Position of molten metal passage % | Amount of lubricant supplied at occurrence of cramp scratches g/min | Rate of transfer of lubricant % |
|---|---|---|---|---|---|---|---|
| Ex. 205 | 30 | 1200 | 3(a) | 15.0 | 10 | 0.17 | 8 |
| Ex. 206 | 30 | 1200 | 3(a) | 15.0 | 8 | 0.24 | 9 |
| Ex. 207 | 60 | 700 | 3(a) | 30.0 | 8 | 0.27 | 9 |
| Ex. 208 | 30 | 1200 | 3(a) | 20.0 | 15 | 0.15 | 7 |
| Ex. 209 | 30 | 1200 | 3(a) | 20.0 | 8 | 0.25 | 9 |
| Ex. 210 | 30 | 1200 | 3(a) | 20.0 | 5 | Breakout | — |
| Ex. 211 | 30 | 1200 | 3(a) | 10.0 | 20 | 0.12 | 7 |
| Ex. 212 | 30 | 1200 | 3(a) | 10.0 | 8 | 0.21 | 9 |
| Ex. 213 | 30 | 1200 | 3(a) | 10.0 | 5 | Breakout | — |
| Ex. 214 | 30 | 1200 | 3(a) | 15: lower semicircle | 20 | 0.12 | 7 |
| Ex. 215 | 30 | 1200 | 3(a) | 15: lower semicircle | 8 | 0.24 | 9 |
| Ex. 216 | 30 | 1200 | 3(a) | 15: lower semicircle | 5 | Breakout | — |
| Comp. Ex. 201 | 30 | 1200 | None | 15.0 | 5 | Breakout | — |
| Comp. Ex. 202 | 60 | 700 | None | 30.0 | 5 | Breakout | — |

In the high-speed casting, as shown in Comparative Examples 201 and 202, breakout occurred at 5% of the rate of the lower position of the inner wall of the molten metal passage allowing communication between the tundish and the mold to the inside diameter of the mold. It was found that the amount of the lubrication oil decreased in accordance with an increment of the rate from 8%. That is to say, it was found that high-speed casting could be performed even when the amount of the lubrication oil supplied was suppressed to 0.2 g/min or less.

As has been described in the foregoing, in the present invention, since an insulation member between the molten metal-receiving portion and the mold of the continuous casting apparatus is provided with a separation layer, also since a lubricant supply conduit is configured so as to enable supply of lubricant not only from the upstream end of the mold but also from the downstream end thereof and further since the lower position of the inner wall of a molten alloy passage is prescribed relative to the lower position of the inside wall of the mold, high-speed casting can be performed stably and smoothly even when the amount of the lubricant to be supplied is reduced.

Therefore, the present invention is useful for performing high-speed casting stably and smoothly and can advantageously be used in reducing ingot failure to a great extent.

What is claimed is:

1. A continuous casting apparatus for producing aluminum alloy cast bars, comprising:

a molten metal-receiving portion containing molten aluminum alloy;

a horizontal mold which has an upstream end and a downstream end and to which the molten aluminum alloy is supplied through the upstream end of the mold;

an insulation member which is disposed between the molten metal-receiving portion and the upstream end of the mold and which has a molten metal passage for allowing communication between the molten metal-receiving portion and the mold; and a separation layer disposed on the insulation layer, wherein the separation layer is disposed on a side surface of the insulation member facing the molten metal-receiving portion or is disposed between two insulation members, the separation layer having an aperture which is in communication with the molten metal passage, wherein, in relation to the insulation member disposed between the upstream end of the mold and the separation layer, the insulation member has a portion facing a hollow portion of the mold and having an area of 40 to 85%, in an area ratio, of a radial cross sectional area of the hollow portion of the mold.

2. A continuous casting apparatus according to claim 1, wherein the separation layer has on a side of the aperture a circumferential portion bending toward the upstream end of the mold.

3. A continuous casting apparatus according to claim 1, wherein the separation layer is formed of a material which prevents passage of a lubricant and a gasified lubricant therethrough.

4. A continuous casting apparatus according to claim 1, wherein the mold is provided in an inner wall thereof at a position proximal to the upstream end thereof with a lubricant supply conduit that is extended toward the downstream end of the mold along the inner wall thereof.

5. A continuous casting apparatus according to claim 1, wherein the mold is provided in an inner wall thereof at a position proximal to the upstream end thereof with a lubricant supply conduit that is branched, so that a branched end thereof is located at a position proximal to the downstream end of the mold.

6. A continuous casting apparatus according to claim 1, wherein the mold and molten metal passage have a relationship defined such that a lowermost position of an inner wall of the molten metal passage is higher than a lowermost position of an inner wall of the mold by 8% or more of an inner diameter of the mold.

7. A continuous casting apparatus according to claim 1, wherein a thermal conductivity of a separation layer is 0.04 to 0.6 cal/cm·sec·° C.

8. A continuous casting apparatus according to claim 1, wherein a separation layer has a length from a wall surface of the molten metal passage to the outer circumferential end of the separation layer of not less than 1.1 times a length from an opening end to a peripheral wall of a hollow portion of the mold.

9. A continuous casting method for producing aluminum alloy cast bars, comprising the steps of:

disposing an insulation member between a molten metal-receiving portion containing molten aluminum alloy and an upstream end of a horizontal mold also having a downstream end and which has a molten metal passage for allowing communication between the molten metal-receiving portion and the mold;

providing a separation layer disposed on the insulation layers, wherein the separation layer is disposed on a side surface of the insulation member facing the molten metal-receiving portion or is disposed between two insulation members, the separation layer having an aperture which is in communication with the molten metal passage;

in relation to the insulation member disposed between the upstream end of the mold and the separation layer, making an area of a portion of the insulation member facing a hollow portion of the mold 40 to 85%, in an area ratio, of a radial cross sectional area of the hollow portion of the mold supplying the molten aluminum alloy to the mold through the upstream end of the mold; and performing continuous casting while blocking a lubricant which has been supplied from a lubricant supply conduit to the mold and transferred to the insulation member with the separation layer.

10. A continuous casting method according to claim 9, wherein the lubricant supply conduit provided in an inner wall of the mold at a position proximal to the upstream end of the mold and extended toward the downstream end of the mold along the inner wall thereof.

11. A continuous casting method according to claim 9, wherein the lubricant supply conduit provided in the inner wall of the mold at a position proximal to the upstream end of the mold is branched, so that a branched end thereof is located at a position proximal to the downstream end of the mold.

12. A continuous casting method according to claim 9, wherein the molten metal passage and mold have a relationship such that a lowermost position of an inner wall of the molten metal passage is higher than a lowermost position of an inner wall of the mold by 8% or more of an inner diameter of the mold.

13. A continuous casting method according to claim 9, using a separation layer having a thermal conductivity of 0.04 to 0.6 cal/cm·sec·° C.

14. A continuous casting method according to claim 9, using a separation layer having a length from a wall surface of the molten metal passage to the outer circumferential end of the separation layer of not less than 1.1 times a length from an opening end to a peripheral wall of a hollow portion of the mold.

15. A continuous casting method according to claim 9, wherein the molten aluminum alloy has a magnesium content of 0.5 mass % or more.

16. A continuous casting method according to claim 9, wherein the molten aluminum alloy has a composition of Si (content: 0.05 to 1.3 mass %), Fe (content: 0.1 to 0.7 mass %), Cu (content: 0.1 to 2.5 mass %), Mn (content: 0.05 to 1.1 mass %), Mg (content: 0.5 to 3.5 mass %), Cr (content: 0.04 to 0.4 mass %) and Zn (content: 0.05 to 8 mass % or less).

* * * * *